US009570830B2

(12) United States Patent
Yamada

(10) Patent No.: US 9,570,830 B2
(45) Date of Patent: Feb. 14, 2017

(54) TERMINAL HOLDING MEMBER AND CLAMPING DEVICE INCLUDING TERMINAL HOLDING MEMBER AND ELECTROCONDUCTIVE MEMBER

(71) Applicant: HIROSE ELECTRIC CO., LTD., Tokyo (JP)

(72) Inventor: Yoshihisa Yamada, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/926,100

(22) Filed: Oct. 29, 2015

(65) Prior Publication Data

US 2016/0126644 A1 May 5, 2016

(30) Foreign Application Priority Data

Oct. 31, 2014 (JP) ..... 2014-222550

(51) Int. Cl.

| | |
|---|---|
| ***H01R 4/38*** | (2006.01) |
| ***H01R 13/20*** | (2006.01) |
| ***H01R 4/48*** | (2006.01) |
| *H01R 11/12* | (2006.01) |

(52) U.S. Cl.

CPC ..... *H01R 13/20* (2013.01); *H01R 4/489* (2013.01); *H01R 11/12* (2013.01)

(58) Field of Classification Search

CPC ..... H01R 4/34; H01R 4/5025; H01R 4/36; H01R 4/363; H01R 4/301; H01R 4/38; H01R 4/4809

USPC ..... 439/801, 805, 810–816

See application file for complete search history.

(56) References Cited

U.S. PATENT DOCUMENTS

| | | | | |
|---|---|---|---|---|
| 2,205,322 A * | 6/1940 | Thomas, Jr. | ..... | H01R 4/301 24/135 N |
| 2,976,515 A * | 3/1961 | Charbonneau | ..... | H01R 4/363 439/811 |
| 3,891,298 A * | 6/1975 | Yorgin | ..... | H01H 71/08 439/620.08 |
| 4,213,669 A * | 7/1980 | Wittes | ..... | H01R 4/36 439/811 |

(Continued)

FOREIGN PATENT DOCUMENTS

JP 63-289779 11/1988

*Primary Examiner* — Thanh Tam Le

(74) *Attorney, Agent, or Firm* — Rankin, Hill & Clark LLP

(57) ABSTRACT

A terminal holding member has a tubular shape and includes an accommodation portion into which an electroconductive member is inserted. The terminal holding member elastically holds a mating terminal and the electroconductive member when the mating terminal is inserted into a gap that is formed between the terminal holding member and the electroconductive member inserted into the accommodation portion. The terminal holding member includes a bottom portion that supports a bottom surface of the electroconductive member inserted into the accommodation portion, a surface-contact portion that faces the bottom portion and that is capable of coming into surface-contact with a first surface of the mating terminal, and a spring portion that connects the bottom portion and the surface-contact portion to each other so that the terminal holding member has spring properties with which the surface-contact portion is urged toward the bottom portion.

12 Claims, 17 Drawing Sheets

(56) References Cited

U.S. PATENT DOCUMENTS

| | | | | | |
|---|---|---|---|---|---|
| 4,629,281 | A * | 12/1986 | Kruger | H01R 12/515 | 439/791 |
| 5,493,085 | A * | 2/1996 | Kolberg | H01R 4/34 | 200/51 R |
| 5,978,208 | A * | 11/1999 | Helms | H01H 1/5855 | 200/284 |
| 6,102,750 | A * | 8/2000 | Little | H01R 4/302 | 439/812 |
| 6,475,038 | B1 * | 11/2002 | Franck | H01R 4/363 | 439/811 |
| 6,529,112 | B1 * | 3/2003 | Leone | H01R 4/36 | 337/113 |
| 7,404,745 | B1 * | 7/2008 | Wu | H01R 4/26 | 439/709 |

* cited by examiner

TERMINAL HOLDING MEMBER AND CLAMPING DEVICE INCLUDING TERMINAL HOLDING MEMBER AND ELECTROCONDUCTIVE MEMBER

BACKGROUND OF THE INVENTION

1. Field of the Invention

The present invention relates to a terminal holding member, and, in particular, to a terminal holding member having a tubular shape and including an accommodation portion into which an electroconductive member is inserted. The present invention also relates to a clamping device including the terminal holding member and the electroconductive member.

2. Description of the Related Art

For example, a terminal holding member is used as a connection terminal of a busbar of a joint box. With the terminal holding member, a mating terminal can be inserted into a gap formed by an accommodation portion of the terminal holding member and an electroconductive member inserted into the accommodation portion. When the mating terminal is inserted into the gap, the terminal holding member can hold the mating terminal and the electroconductive member together.

Japanese Unexamined Patent Application Publication No. 63-289779 describes such a terminal holding member and an example of a clamping device including the terminal holding member and an electroconductive member. FIG. 21 is a perspective view of a terminal holding member 112 and an electroconductive member 110 disclosed in Japanese Unexamined Patent Application Publication No. 63-289779. FIG. 22 is a sectional view of a clamping device including the terminal holding member 112 and the electroconductive member 110.

The terminal holding member 112, which is made by punching and bending a single electroconductive metal plate, has a flat tubular shape as a whole and includes an accommodation portion extending through the center thereof. The accommodation portion includes a flat plate portion 112*a*, a pair of spring contact portions 112*b* for holding a plate-shaped portion 111 from both sides of the flat plate portion 112*a*, and a pair of press spring portions for fixing the terminal holding member 112 to the plate-shaped portion 111. The electroconductive member 110 is inserted into the accommodation portion beforehand. The electroconductive member 110 has an L-shape in a side view and includes the plate-shaped portion 111, which is inserted into the accommodation portion of the terminal holding member 112. The plate-shaped portion 111 has a rib 111*a* at the center thereof.

After the plate-shaped portion 111 has been inserted into the accommodation portion, a mating terminal 113 is inserted into a gap between the accommodation portion and the plate-shaped portion 111. The terminal holding member 112 can elastically hold both the plate-shaped portion 111 and the mating terminal 113 together. In particular, the terminal holding member 112 elastically holds the plate-shaped portion 111 and the mating terminal 113 by pressing the mating terminal 113 toward the plate-shaped portion 111 by using thickness portions of the pair of spring contact portions 112*b* and a pair of press spring portions 112*d* and in the longitudinal direction along the rib 111*a*.

However, in the existing technology described above, the terminal holding member 112 elastically holds the plate-shaped portion 111 and the mating terminal 113 by using the thickness portions of the pair of spring contact portions 112*b* and the pair of press spring portions 112*d*, which are very thin plate-shaped members, and in a narrow region extending substantially in the width direction of the rib 111*a*. As a result, the existing technology has a problem in that the mating terminal 113 cannot be sufficiently pressed against the plate-shaped portion 111. When the mating terminal is not sufficiently pressed against the electroconductive member, a high contact resistance is generated between the mating terminal and the electroconductive member. In particular, when the terminal holding member is used to pass a comparatively large electric current, serious problems, such as overheating and fire, might occur.

SUMMARY OF THE INVENTION

An object of the present invention, which has been devised to solve the problems of the existing technology, is to provide a terminal holding member that can come into contact with a mating terminal over a larger contact area by using a surface-contact portion. The terminal holding member can press the mating terminal against an electroconductive member over a larger area by pressing the mating terminal against the electroconductive member with substantially the entirety of the surface-contact portion.

(1) According to the present invention, there is provided a terminal holding member having a tubular shape and including an accommodation portion into which an electroconductive member is inserted. The terminal holding member elastically holds a mating terminal and the electroconductive member when the mating terminal is inserted into a gap that is formed by the accommodation portion and the electroconductive member inserted into the accommodation portion. The terminal holding member includes a bottom portion that supports a bottom surface of the electroconductive member inserted into the accommodation portion, a surface-contact portion that faces the bottom portion and that is capable of coming into surface-contact with a first surface of the mating terminal, and a spring portion that connects the bottom portion and the surface-contact portion to each other so that the terminal holding member has spring properties with which the surface-contact portion is urged toward the bottom portion.

With this structure, the terminal holding member can come into contact with the mating terminal over a larger contact area by using the surface-contact portion, and the mating terminal is urged against the electroconductive member with substantially the entirety of the surface-contact portion. Thus, the mating terminal is pressed against the electroconductive member over a larger area, so that the contact resistance between the mating terminal and the electroconductive member is reduced. As a result, it is possible to provide a terminal holding member having a structure that does not easily generate heat.

(2) In the terminal holding member described in (1), at least a part of the spring portion may be located farther from the bottom portion than the surface-contact portion in a direction from the bottom portion toward the surface-contact portion.

With this structure, the terminal holding member can have stronger spring properties.

(3) In the terminal holding member described in (2), the part of the spring portion located farther from the bottom portion may be substantially arch-shaped.

(4) Preferably, in the terminal holding member described in any one of (1) to (3), the first surface of the mating terminal and an inner wall of the surface-contact portion that comes into surface-contact with the first surface are flat surfaces.

When the contact surfaces of the mating terminal and the surface-contact portion are flat surfaces, a force from the surface-contact portion can be more directly and more efficiently transmitted to the mating terminal.

(5) Preferably, in the terminal holding member described in any one of (1) to (4), a top surface of the electroconductive member and a second surface of the mating terminal come into surface-contact with each other along a flat surface.

When the contact surfaces of the electroconductive member and the mating terminal are flat surfaces, the electroconductive member and the mating terminal can be in contact with each other more directly and more efficiently.

(6) Preferably, in the terminal holding member described in any one of (1) to (5), the surface-contact portion has a through-hole through which a movable member is to be inserted, the movable member being engageable with the mating terminal inserted into the gap to prevent extraction of the mating terminal from the terminal holding member.

When the surface-contact portion has the through-hole, the movable member can access the mating terminal, and thereby extraction of the mating terminal from the terminal holding member can be prevented.

(7) Preferably, the terminal holding member described in (6) further includes an upright portion disposed around the through-hole so as to protrude along a movement direction of the movable member on a side from which the movable member is inserted into the through-hole.

When the terminal holding member includes the upright portion, even when a force is applied from the movable member in an unintended direction, the influence of such a force can be reduced.

(8) Preferably, the terminal holding member described in any one of (1) to (7) further includes a guide portion for the mating terminal, the guide portion being disposed at an edge of the surface-contact portion and being inclined toward the accommodation portion.

When the terminal holding member includes the guide portion, the mating terminal can be smoothly guided into the gap of the terminal holding member.

(9) Preferably, the terminal holding member described in any one of (1) to (8) is made by shaping a single metal plate so that a gap between abutting edges of the metal plate is located in the bottom portion.

By making the terminal holding member from a single plate, the cost of making the terminal holding member can be reduced. By locating the gap between abutting edges of the plate member in the bottom portion, the contact area between the surface-contact portion and the mating terminal can be made larger and the terminal holding member can have sufficient spring properties.

(10) Preferably, in the terminal holding member described in any one of (1) to (9), the electroconductive member is a flat plate member.

When the electroconductive member is a flat plate member, the electroconductive member can easily come into contact with the bottom portion of the terminal holding member or the mating terminal.

(11) Preferably, the terminal holding member described in any one of (1) to (10) is made of a stainless steel or a stainless steel alloy.

In the present structure, the electroconductive member and the mating terminal, which are directly in contact with each other, are made to elastically contact each other from the outer sides thereof. Therefore, it is not necessary that the terminal holding member be made of a material having high electroconductivity. Accordingly, a stainless steel, which has low electroconductivity but strong spring properties, can be used.

(12) A clamping device may include the terminal holding member described in any one of (1) to (11), and the electroconductive member.

With the present invention, there is provided a terminal holding member that can come into contact with a mating terminal over a larger contact area by using a surface-contact portion. The terminal holding member can press the mating terminal against an electroconductive member over a larger area by pressing the mating terminal against the electroconductive member with substantially the entirety of the surface-contact portion.

DESCRIPTION OF THE PREFERRED EMBODIMENTS

Hereinafter, an embodiment of the present invention will be described with reference to the drawings.

Figure 1:
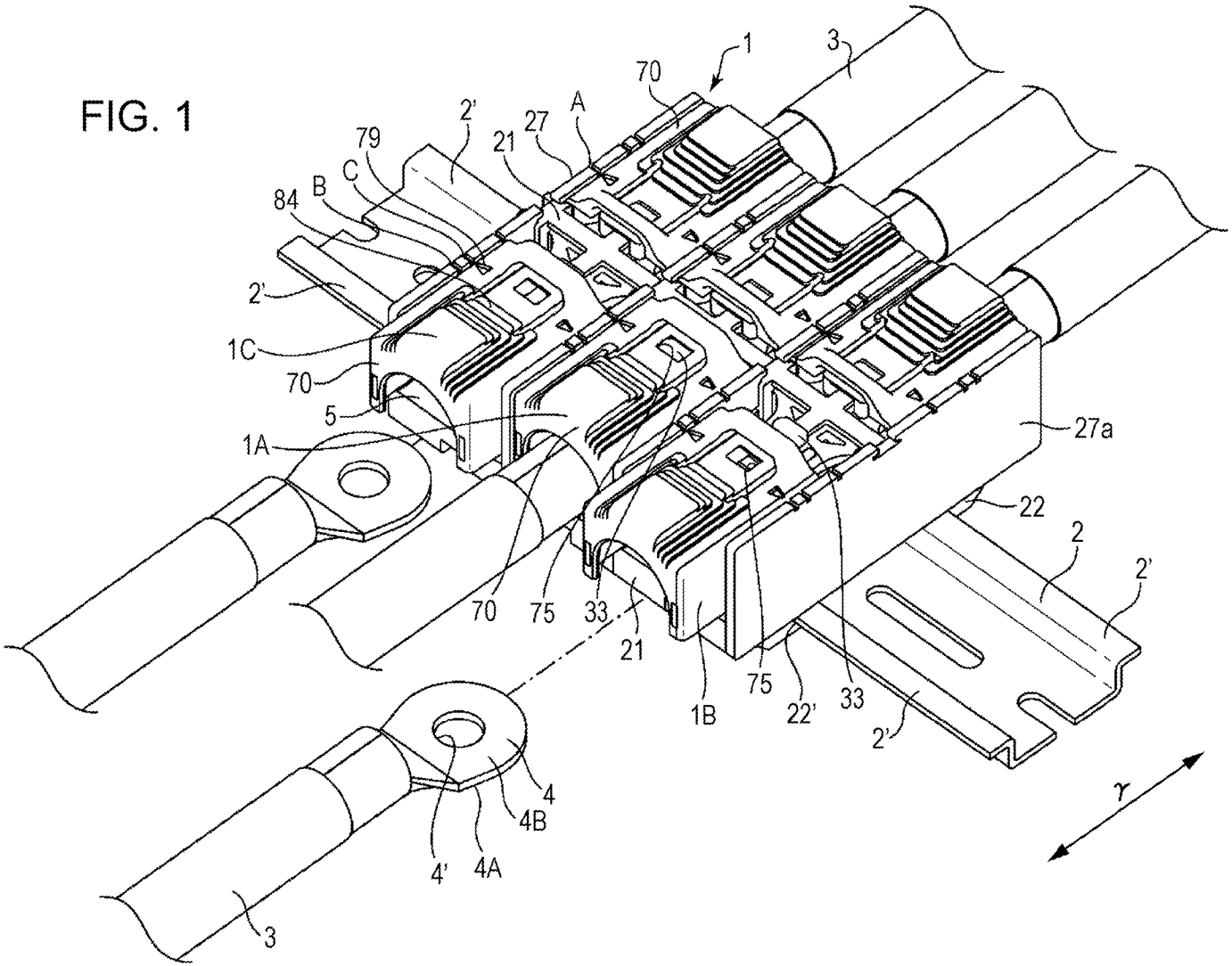
FIG. 1 is a perspective view illustrating an example of the use of an electrical connector that can be used in the present invention.
Figure 2:
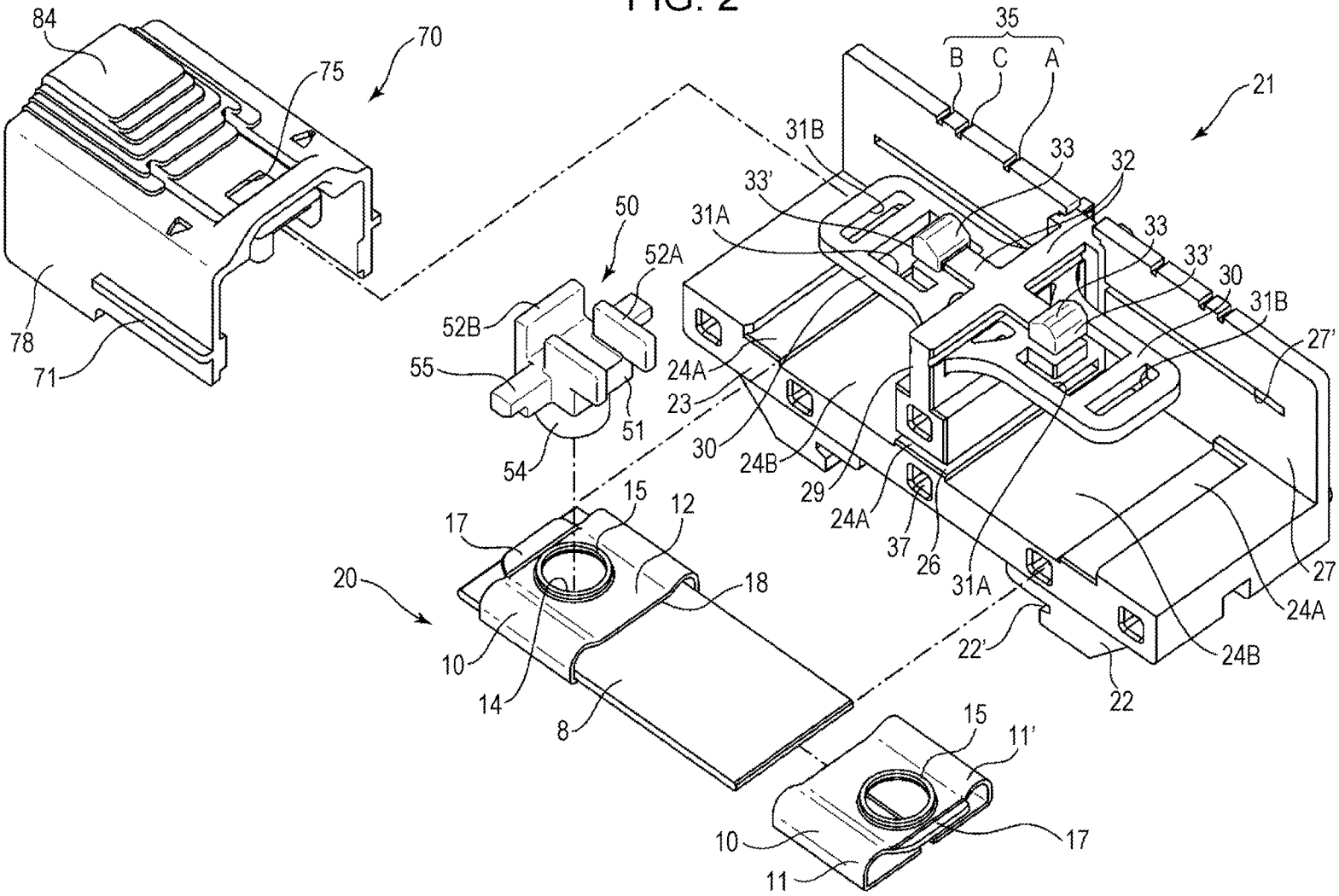
FIG. 2 is an exploded perspective view of an electrical connector that can be used in the present invention.

FIG. 1 is a perspective view illustrating an example of the use of an electrical connector 1 that can be used in the present invention. FIG. 2 is an exploded perspective view of the electrical connector 1 that can be used in the present invention.

As illustrated in FIG. 2, the electrical connector 1 has a bilaterally symmetrical shape and includes a housing 21, a clamping device 20 placed in the housing 21, a movable member 50 that is movably disposed in the housing 21, and a slide member 70 that is slidably disposed on the housing 21 of the electrical connector 1 in a state in which at least a part thereof is exposed to the outside. The clamping device 20 includes a terminal holding member 10 and an electroconductive member 8. In FIG. 2, for convenience, the structure of only one side of the electrical connector 1 is illustrated in detail.

In the example shown in FIG. 1, a plurality of (here, three) electrical connectors 1 according to the present invention, each illustrated in FIG. 2, are used as a multiple connector in which the electrical connectors 1 are connected to each other side-by-side. Note that the number of the electrical connectors 1 and the method of connecting the electrical connectors 1 are not particularly limited. For example, only one electrical connector 1 shown in FIG. 2 may be used, or any number, other than three, of the electrical connectors 1 may be used. The electrical connectors 1 may be connected so as to be displaced from each other. The electrical connectors 1 may be placed on a rail 2. When placing the electrical connector 1 on the rail 2, rail grooves 22', which are engageable with guides 2' at both edges of the rail 2, are formed in leg portions 22 of the housing 21 of the electrical connector 1.

By using the electrical connector 1, a pair of terminals 4, each attached to an end of a corresponding one of cables 3, are disposed so as to abut against each other from both sides of the electrical connector 1. As a result, the pair of terminals 4 are electrically connected to each other through the electroconductive member 8, which is disposed in the electrical connector 1. Note that the terminal 4 is not limited to a plate-shaped round terminal used in this example. The electrical connector 1 can be used for a purpose other than connecting a pair of terminals 4. For example, a terminal 4 may be connected to only one side of the electrical connector 1, and a cable may be directly connected the other side of the electrical connector 1 without using a terminal 4.

Each terminal 4 is inserted into or extracted from the electrical connector 1 through an access hole 5 of the electrical connector 1 in the directions indicated by a double sided arrow "γ" in FIG. 1. The terminal 4 has a through-hole 4' at the center thereof. When the terminal 4 is inserted into the electrical connector 1 and a part (a stopper 54) of the movable member 50, which is disposed in the electrical connector 1, is inserted into the through-hole 4', the movable member 50 and the terminal 4 engage each other. The movable member 50 and the terminal 4 disengage each other when the stopper 54 of the movable member 50 is extracted from the through-hole 4'. By using these movements, extraction of the terminal 4 from the electrical connector 1 can be prevented or allowed. Note that engagement of the movable member 50 and the terminal 4 need not be performed by using a through-hole and an insertion portion (the through-hole 4' and the stopper 54 of the movable member inserted into the through-hole 4'). For example, the terminal 4 may have a recessed shape, and a part of the movable member may have a protruding shape corresponding to the recessed shaped. It is only necessary that the movable member 50 and the terminal 4 can engage each other to prevent extraction of the terminal 4.

The slide member 70, which is manually operable, can be used to control insertion of the movable member 50 into the through-hole 4' and extraction of the movable member 50 from the through-hole 4'. Accordingly, it is not necessary to directly operate the movable member 50. The slide member 70 is slidably disposed on the housing 21 of the electrical connector 1 in such a way that at least a part of the slide member 70 is exposed to the outside of the electrical connector 1. The sliding directions of the slide member 70 are the same as those of the directions (indicated by the arrow "γ" in FIG. 1) in which each terminal 4 is inserted into and extracted from the electrical connector 1. The slide member 70 has a non-slip portion 84 on an upper surface thereof so that a user can easily operate the slide member 70. As the slide member 70 is slid over the housing 21, the position of the slide member 70 relative to the movable member 50 is changed. In accordance with the change in the position, movement of the movable member 50 relative to the through-hole 4' is controlled. The slide member 70 has indicator marks 79, and a side wall 27 of the housing 21 has markings in an upper part thereof. A user can easily check the position of the slide member 70 relative to the movable member 50 by observing to which markings the indicator marks 79 point. In the present embodiment, the slide member 70 can have three positions A to C relative to the movable member 50.

When the slide member 70 is at the position A as in an electrical connector 1A shown in FIG. 1, extraction of the terminal 4 from the electrical connector 1 is prevented, because the movable member 50 has been inserted into the through-hole 4' of the terminal 4 and the movable member 50 cannot be moved in a direction in which the movable member 50 becomes separated from the terminal 4.

When the slide member 70 is at the position B as in an electrical connector 1B shown in FIG. 1, the terminal 4 can be freely inserted into or extracted from the electrical connector 1, because the movable member 50 has been extracted from the through-hole 4' of the terminal 4.

When the slide member 70 is at the position C as in an electrical connector 1C shown in FIG. 1, as with the case where the slide member 70 is at the position A, the movable member 50 has been inserted into the through-hole 4' of the terminal 4. In this case, however, the movable member 50 can be freely moved in the direction in which the movable member 50 becomes separated from the terminal 4. Accordingly, insertion of the terminal 4 into the electrical connector 1 is allowed.

Figure 3A:
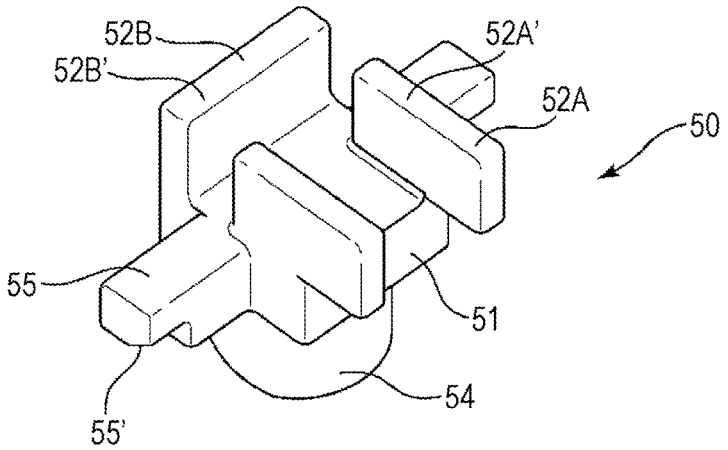
FIGS. 3A and 3B illustrate a movable member.
Figure 3B:
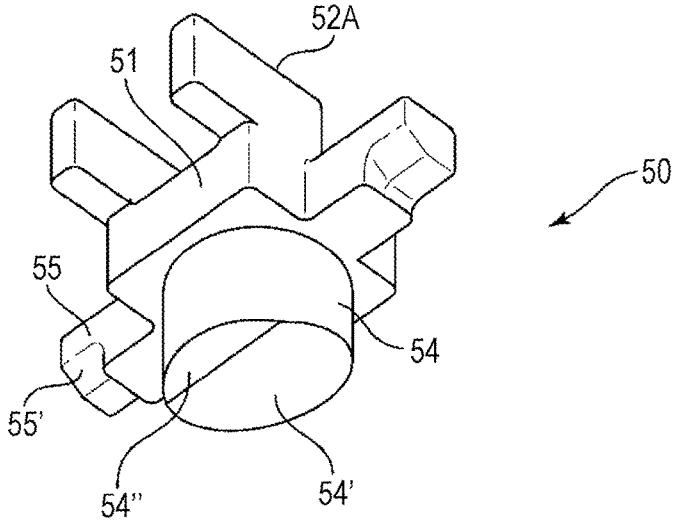

FIGS. 3A and 3B illustrate the movable member 50. FIG. 3A is a top perspective view of the movable member 50, and FIG. 3B is a bottom perspective view of the movable member 50.

The movable member 50 includes a base body 51 having a substantially rectangular parallelepiped shape, arm portions 55 extending from outer walls of the base body 51 in left and right directions, a push-up portion 52 protruding upward from the base body 51, and the stopper 54 protruding downward from the base body 51.

The arm portions 55 are used to control movement of the movable member 50 in a direction in which the movable member 50 approaches the terminal 4 inserted into the electrical connector 1 and in a direction in which the movable member 50 becomes separated from the terminal 4 inserted into the electrical connector 1. The lower sides of the arm portions 55 are in contact with or are capable of coming into contact with protruding portions (inclined portions 80) of the slide member 70. The upper sides of the arm portions 55 are in contact with or are capable of coming into contact with other protruding portions (inner wall protrusions 77) of the slide member 70. In particular, on the lower sides of the arm portions 55, inclined portions 55', which are capable of coming into contact with the protruding portions of the slide member 70 (inclined surfaces 81 of the inclined portions 80), are formed.

The push-up portion 52 includes a pair of longitudinal push-up portions 52A extending in the sliding direction of the slide member 70, and a transversal push-up portion 52B extending in the direction in which the arm portions 55 extend. When the movable member 50 is moved in the direction in which the movable member 50 becomes separated from the terminal 4, the push-up portion 52 collides with a part (an elastic displacement portion 74) of the slide member 70 to prevent the movement of the movable member 50. The push-up portion 52 have tapered portions 52A' and 52B' at ends thereof so that the push-up portion 52 can smoothly collide with the slide member 70.

The stopper 54 has a substantially cylindrical shape as a whole. The bottom of the stopper 54 is formed as an inclined portion 54', and a horizontal portion 54" is formed at an end of the inclined portion 54'. The stopper 54 prevents or allows extraction of the terminal 4 from the electrical connector 1 by being inserted into and extracted from, for example, the through-hole 4' of the terminal 4 inserted into and extracted from the electrical connector 1.

Figure 4:
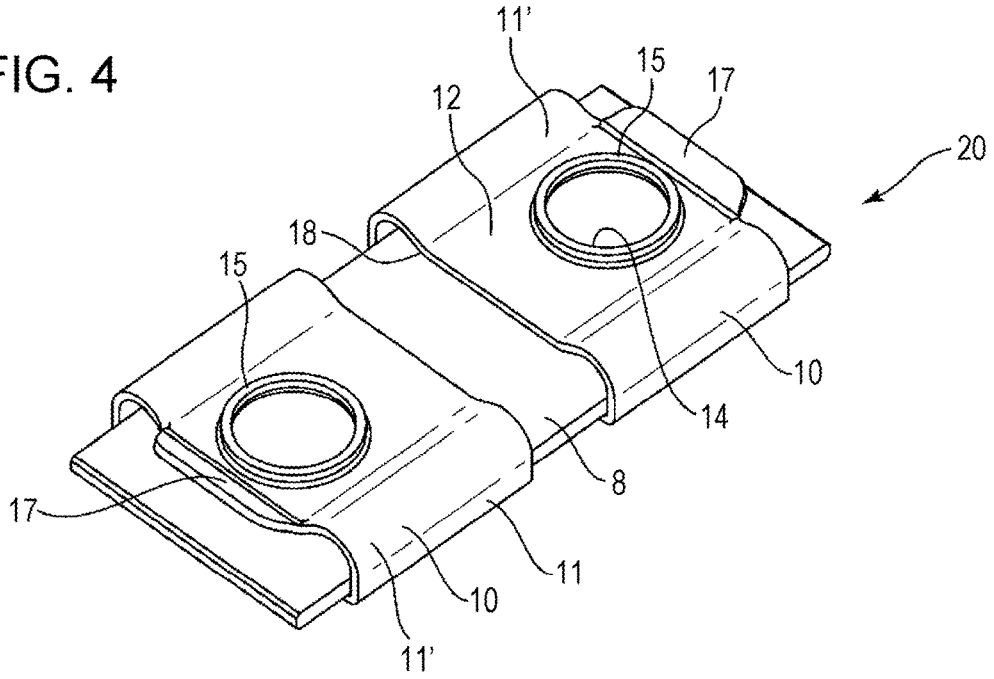
FIG. 4 is a perspective view of a clamping device according to the present invention.
Figure 5A:
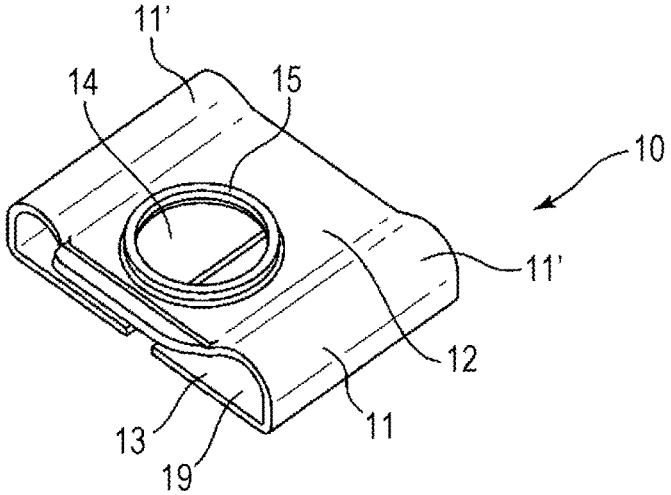
FIGS. 5A to 5C are perspective views of a terminal holding member according to the present invention.
Figure 5B:
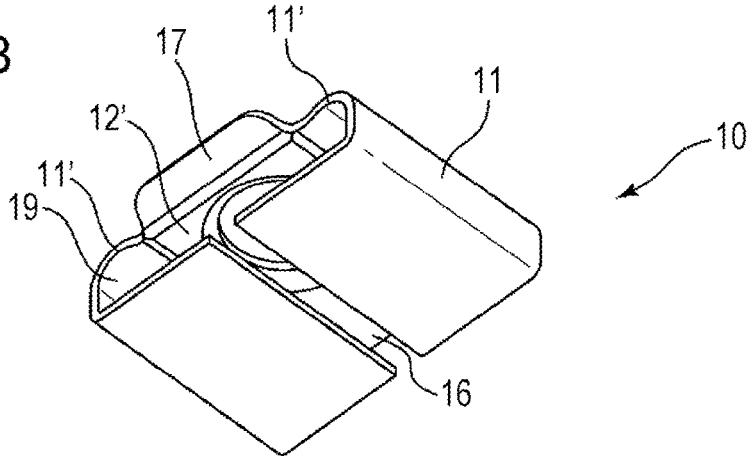
Figure 5C:
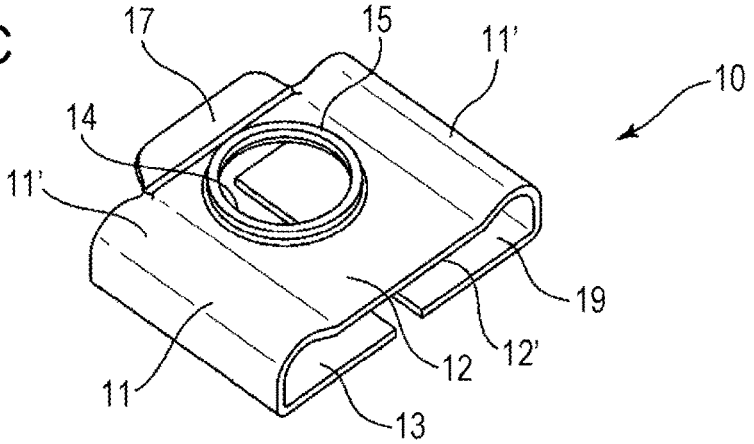

Referring to FIGS. 2, 4, and 5A to 5C, the structure of the clamping device 20 will be described. FIG. 4 is a perspective view of the clamping device 20. FIGS. 5A to 5C are perspective views of the terminal holding member 10 included in the clamping device 20.

Preferably, the electroconductive member 8, which constitute the clamping device 20 together with the terminal holding member 10, is a rectangular flat plate that is comparatively thick and made of a material having a high electroconductivity, such as copper. For example, a pair of terminals 4 inserted into the housing 21 are electrically connected to the electroconductive member 8 and thus can be electrically connected to each other through the electroconductive member 8.

The terminal holding member 10 has a bilaterally symmetrical flat tubular shape and includes an accommodation portion 19. Preferably, the terminal holding member 10 is made by punching and bending a flat thin metal plate. A thin plate can be punched and bent easily, and the terminal holding member 10 can be made at a low cost. When attaching the terminal holding member 10 to the electroconductive member 8, the electroconductive member 8 is inserted into the accommodation portion 19 of the terminal holding member 10. In the clamping device 20 according to the present embodiment, two terminal holding members 10 are attached to two end portions of the one electroconductive member 8. However, needless to say, when connecting the terminal 4 to only one side of the electrical connector 1 as described above, it is only necessary that only one terminal holding member 10 be attached to the electroconductive member 8.

The terminal holding member 10 includes a bottom portion 13 that supports a bottom surface 8B of the electroconductive member 8 inserted into the accommodation portion 19, a surface-contact portion 12 facing the bottom portion 13, and spring portions 11 that connect the bottom portion 13 and the surface-contact portion 12 to each other.

The surface-contact portion 12 has a through-hole 14 into which a part (the stopper 54) of the movable member 50 is inserted. The movable member 50 can access the terminal 4 in the terminal holding member 10 through the through-hole 14. An upright portion 15 is disposed around the through-hole 14. The upright portion 15 protrudes along the movement direction of the movable member 50 on a side from which the movable member 50 is inserted into the through-hole 14. When the movable member 50 receives an accidental force that may tilt the movable member 50 in the through-hole 14 toward the edge of the through-hole 14, the upright portion 15 can reduce the influence of such a force.

At least a part 11' of each of the spring portions 11 is located at a position farther than the surface-contact portion 12 from the bottom portion 13 in the direction from the bottom portion 13 toward the surface-contact portion 12. At least an end portion of the spring portion 11 is substantially arch-shaped. With such a shape, the spring portions 11 have strong spring properties with which the surface-contact portion 12 is urged toward the bottom portion 13. A gap 16 between abutting edges, which is formed when a plate is bent, is located not in the surface-contact portion 12 but in the bottom portion 13. By locating the gap 16 in the bottom portion 13, the contact area between the surface-contact portion 12 and the terminal 4 can be made larger and a sufficiently large force can be applied from the surface-contact portion 12 toward the bottom portion 13.

Figure 6:
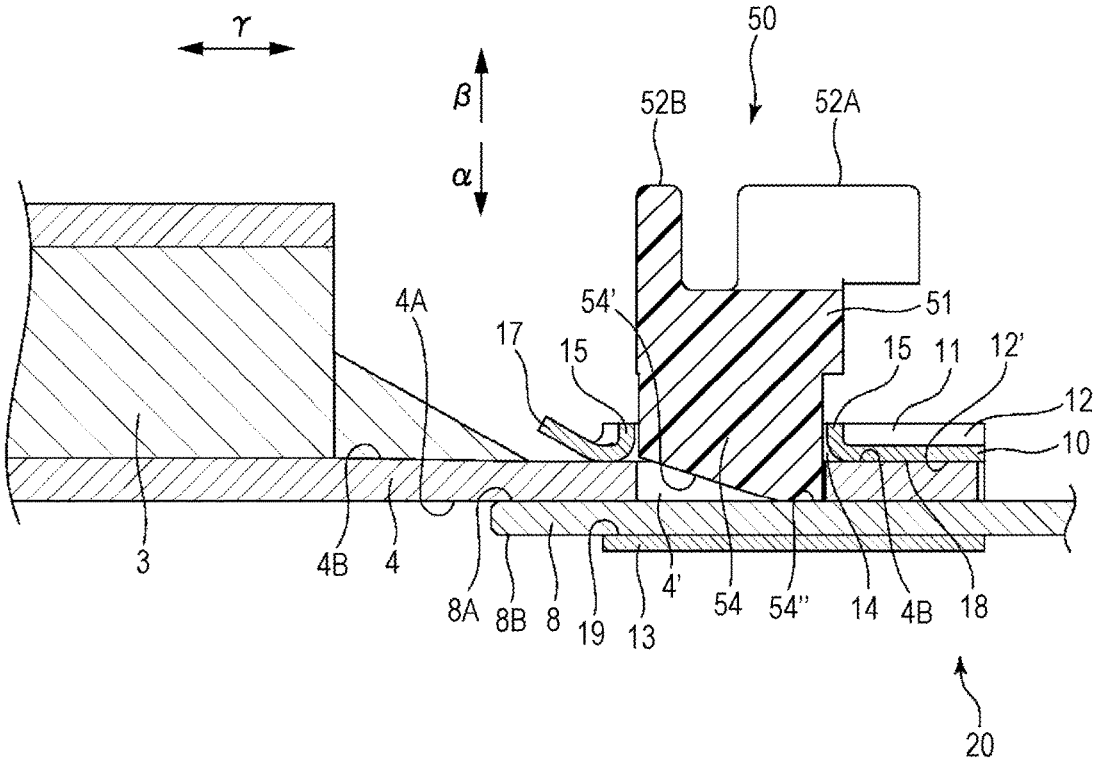
FIG. 6 is a central sectional view illustrating how the movable member fixes a terminal in place.

Referring to FIG. 6, how the movable member 50 fixes the terminal 4 in place will be described. FIG. 6 is a central sectional view of one side of the clamping device 20, illustrated with the terminal 4 and the movable member 50. FIG. 6 illustrates a state in which the movable member 50 has been inserted into the through-hole 14 of the surface-contact portion 12.

The terminal 4 is inserted into a gap 18 in the clamping device 20 laterally (in the direction of the arrow "γ"). The gap 18 is formed between the surface-contact portion 12 and the electroconductive member 8 when the electroconductive member 8 is inserted into the accommodation portion 19. A guide portion 17, which is inclined toward the accommodation portion 19, may be disposed at an edge of the surface-contact portion 12 so that the terminal 4 can be smoothly guided into the gap 18.

When the terminal 4 is inserted into the gap 18, the terminal holding member 10 elastically holds the terminal 4 and the electroconductive member 8, which has been inserted into the accommodation portion 19 beforehand, by using the elastic function of the terminal holding member 10. At this time, a first surface 4A of the terminal 4 can come into direct contact with a top surface 8A of the electroconductive member 8. As a result, the contact resistance between the terminal 4 and the electroconductive member 8 is considerably smaller than that of a case where they are connected to each other through a terminal or the like. As described above, with the present structure, the terminal holding member 10 makes the electroconductive member 8 and the terminal 4, which are in direct contact with each other, be in elastic contact with each other from the outside thereof. Therefore, in contrast to existing structures in which the terminal holding member 10 itself is used as an electroconductor, it is not necessary to make the terminal holding member 10 from a material having a high electroconductivity. As a result, the terminal holding member 10 can be made from a material having a low electroconductivity but strong spring properties, such as a stainless steel or a stainless steel alloy. By adjusting the thickness and the material of a plate from which the terminal holding member 10 is made, the spring properties of the terminal holding member 10 can be finely adjusted.

When the terminal 4 is inserted into the gap 18, the entirety of the surface-contact portion 12 of the terminal holding member 10, excluding the through-hole 14 for inserting and extracting the movable member 50, can come into surface-contact with a second surface 4B of the terminal 4. Accordingly, substantially the entirety of the surface-contact portion 12 can urge the terminal 4 toward the electroconductive member 8, so that the terminal 4 can be pressed against the electroconductive member 8 with a larger area and with stronger spring properties. As a result, the contact resistance between the first surface 4A of the terminal 4 and the top surface 8A of the electroconductive member 8 can be reduced, and it is possible to provide the terminal holding member 10 that does not generate heat easily.

Moreover, in the present structure, the contact surface between the first surface 4A of the terminal 4 and the top surface 8A of the electroconductive member 8, the contact surface between the second surface 4B of the terminal 4 and the surface-contact portion 12 of the terminal holding member 10, and the contact surface between the bottom surface 8B of the electroconductive member 8 and the bottom portion 13 of the terminal holding member 10 are all flat surfaces. As a result, these surfaces can be in contact with each other more closely.

Figure 7:
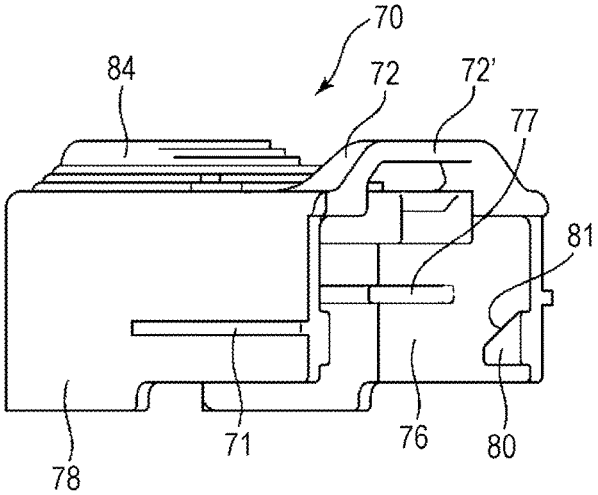
FIG. 7 is a front perspective view of a slide member.
Figure 8A:
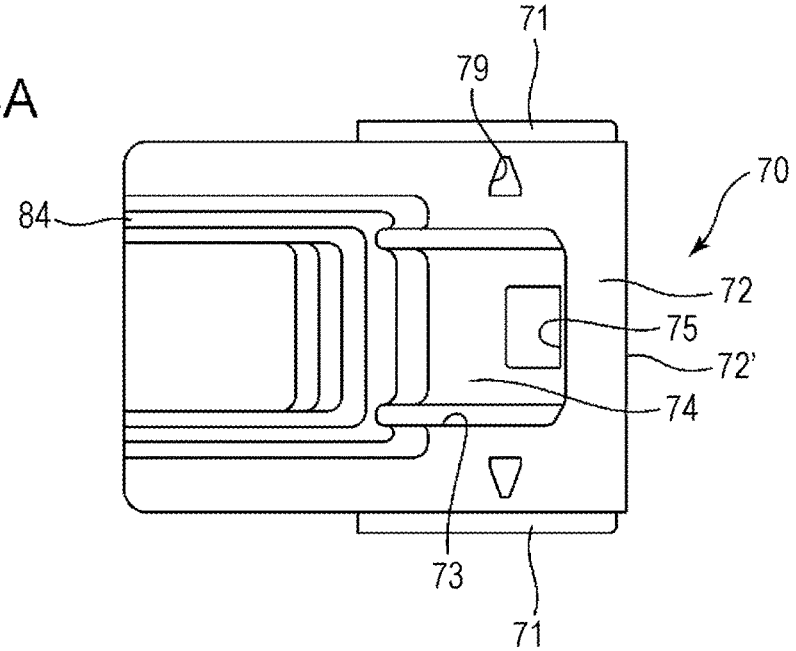
FIGS. 8A, 8B, and 8C are respectively a plan view, a side view, and a front view of the slide member.
Figure 8B:
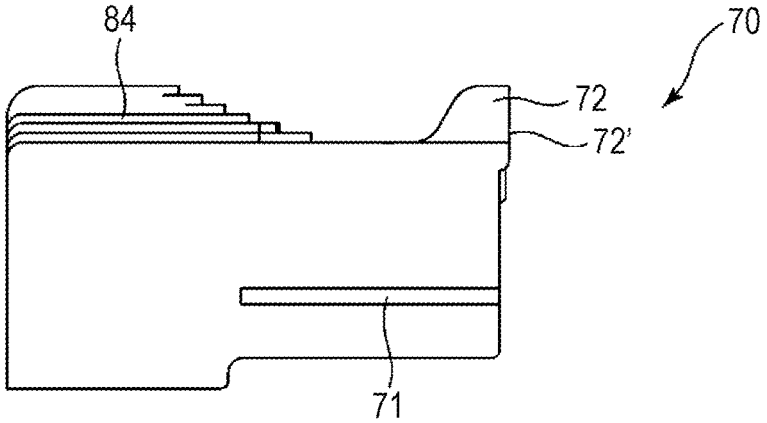
Figure 8C:
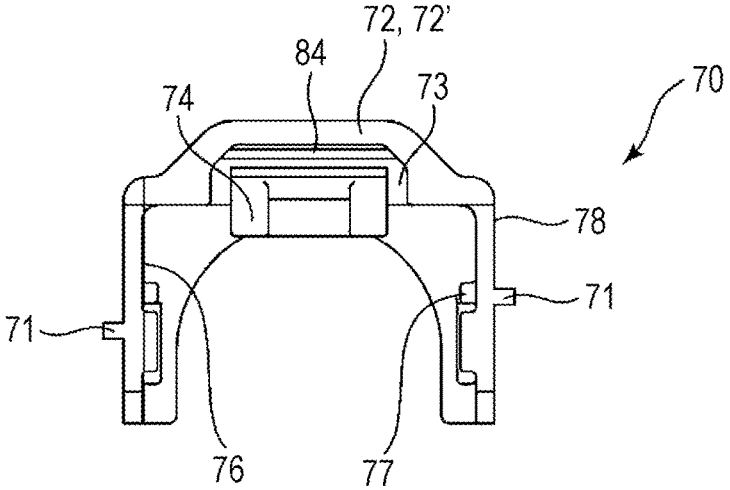

FIGS. 7 and 8A to 8C illustrate the slide member 70. FIG. 7 is a front perspective view of the slide member 70. FIG. 8A is a plan view, FIG. 8B is a side view, and FIG. 8C is a front view of the slide member 70. The slide member 70 is made of, for example, a resin. The slide member has a substantially three-surface structure covered by an upper surface and two side surfaces. The front side of the slide member 70 has a rectangular shape corresponding to the shape of the housing 21. The back side of the slide member 70 is semi-arc shaped so as to correspond to the shape of the cable 3. A front end portion 72 of the slide member 70 has a collision surface 72' that can collide with a predetermined portion (a collision surface 33') of a lock projection 33.

The slide member 70 has the indicator marks 79 in a front part of the upper surface thereof. An angular U-shaped slit 73 is formed in the front part of the upper surface, so that the slide member 70 includes the elastic displacement portion 74 having a free end on the front side thereof. A lock hole 75 may be formed in a front part of the elastic displacement portion 74. A predetermined portion (the lock projection 33) of the housing 21 can be fitted into the lock hole 75, so that the slide member 70 can be locked to the housing 21. The non-slip portion 84, for improving the operability of the slide member 70, is disposed on a back part of the upper surface.

Outer wall protrusions 71 protrude outward from both sides, in particular, from outer walls 78 of the slide member 70. The outer wall protrusions 71 are used to attach the slide member 70 to the housing 21. The outer wall protrusions 71 have bar-like shapes extending in the slide direction and are slidably fitted into corresponding parts (attachment grooves 27') of the housing 21.

The inner wall protrusions 77 and the inclined portions 80 protrude inward from both sides, in particular, from inner walls 76 of the slide member 70. The inner wall protrusions 77 and the inclined portions 80 are used to control movement of the movable member 50 by coming into contact with the arm portions 55 of the movable member 50. To be specific, the inner wall protrusions 77 and the inclined portions 80 are used to control movement of the movable member 50 in the direction in which the movable member 50 approaches the terminal 4 inserted into the electrical connector 1 and in the direction in which the movable member 50 becomes separated from the terminal 4. The inner wall protrusions 77 and the inclined portions 80 are separated from each other in the slide direction. The inclined portions 80 are disposed in front of the inner wall protrusions 77 in the slide direction.

Figure 9:
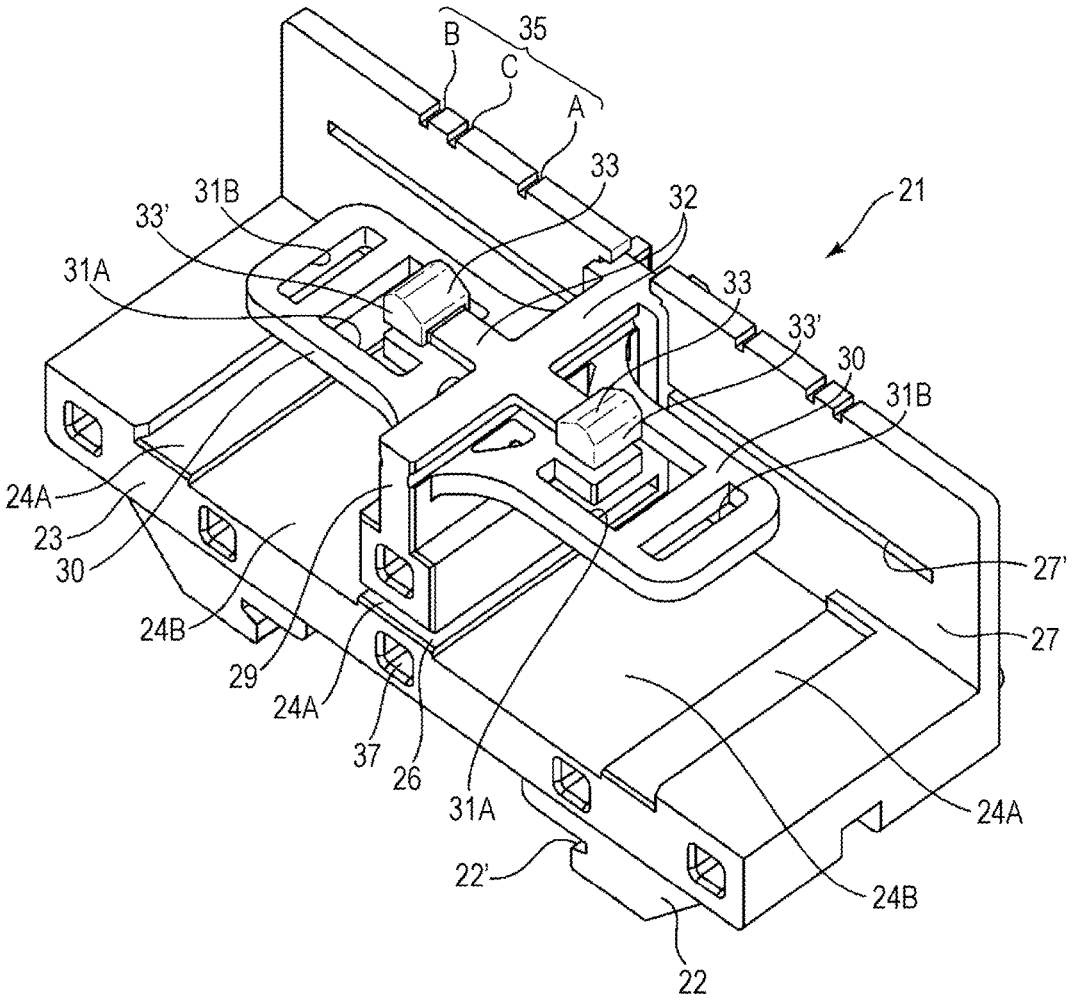
FIG. 9 is a perspective view of a housing.
Figure 10:
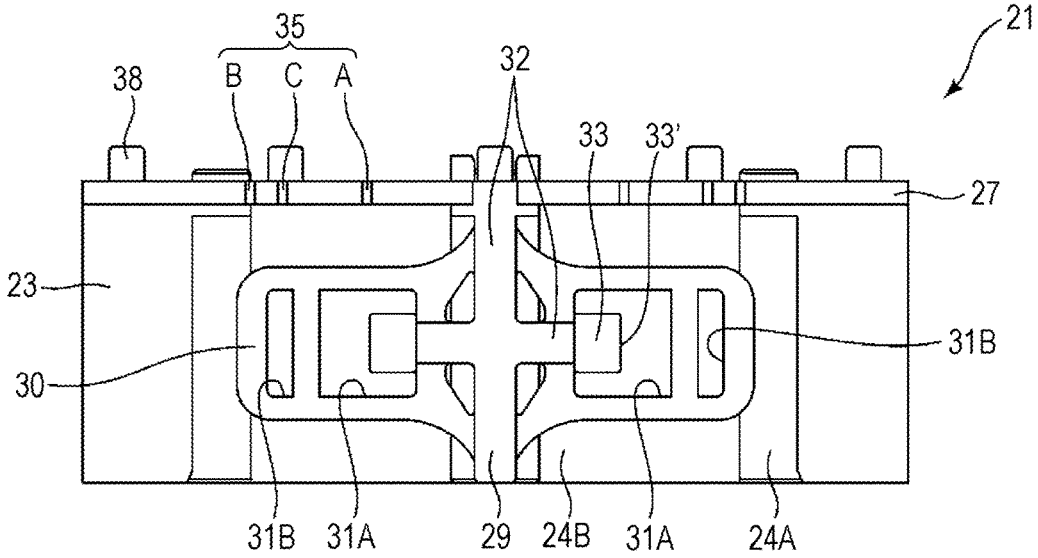
FIG. 10 is a plan view of the housing.
Figure 11:
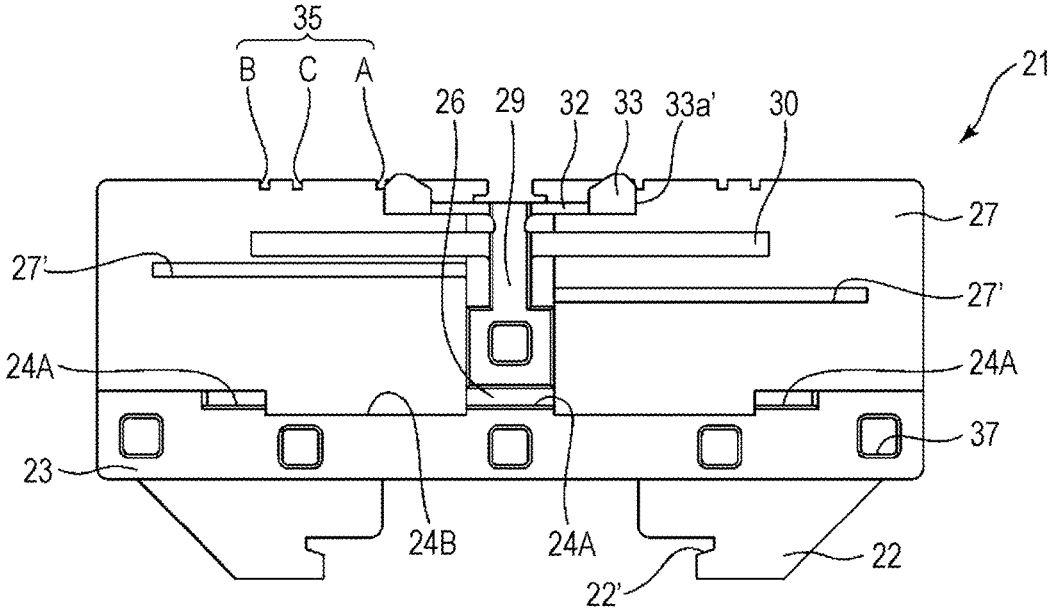
FIG. 11 is a side view of the housing.

FIGS. 9 to 11 illustrate the housing 21. FIG. 9 is a perspective view, FIG. 10 is a plan view, and FIG. 11 is a side view of the housing 21.

The housing 21 mainly includes a base body 23, an upright portion 29 standing at the center of the base body 23, and the side wall 27.

The clamping device 20 is placed in the base body 23. The base body 23 has stepped portions 24, which fit the shape of the clamping device 20, on a surface thereof. The stepped portions 24 include three upper step portions 24A for positioning the electroconductive member 8 of the clamping device 20, and two lower step portions 24B for positioning the terminal holding member 10 of the clamping device 20. The base body 23 may have the leg portions 22, for attaching the housing 21 to the rail 2 (FIG. 1), on the bottom side thereof.

The upright portion 29 is indirectly connected to the base body 23 through the side wall 27. A gap 26, into which the electroconductive member 8 is to be inserted, is formed between the upright portion 29 and one of the upper step portions 24A of the base body 23.

The upright portion 29 includes a top portion 32, which is cross-shaped. At each of free ends of the top portion 32 in the slide direction, the lock projection 33, which is to be fitted into the lock hole 75 of the elastic displacement portion 74 of the slide member 70, protrudes upward. When the slide member 70 is at a predetermined position (the position A, as in the electrical connector 1A shown in FIG. 1), the lock projection 33 is fitted into the lock hole 75 of the slide member 70 to lock the slide member 70 at a predetermined position relative to the housing 21.

A pair of holding pieces 30 are disposed below the lock projections 33. The holding pieces 30 protrude from the upright portion 29 in the same directions in which the lock projections 33 are located. Each of the holding piece 30 serves to hold a part of the movable member 50, that is, the push-up portion 52 (see FIGS. 3A and 3B and other figures), in such a way that the movable member 50 is vertically movable. The longitudinal push-up portions 52A are fitted into holding holes 31A of the holding piece 30. The transversal push-up portion 52B is fitted into a holding hole 31B of the holding piece 30. Because the pair of longitudinal push-up portions 52A are separated from each other, even when the movable member 50 is pushed upward, the longitudinal push-up portions 52A do not collide with the top portion 32, which supports the lock projection 33.

In the example shown in the figures, the side wall 27 is disposed on only one side of the housing 21, because it is assumed that a plurality of electrical connectors 1 are connected to each other and used as shown in FIG. 1. To connect the plurality of electrical connectors 1 to each other, connection columns 38, which protrude outward from a side wall of the base body 23 of one of the electrical connectors 1, are inserted into holes 37 formed at corresponding positions in a side surface of the base body 23 of another of the electrical connectors 1. In the final step of connecting the electrical connectors 1, a side wall 27*a* (see FIG. 1), which does not have the base body 23, is used instead of the electrical connector 1 to close an end of the electrical connectors 1. An attachment groove 27', into which the outer wall protrusion 71 of the slide member 70 is to be inserted, is formed in an inner surface (inner wall) of the side wall 27. When assembling the connector, the outer wall protrusion 71 of the slide member 70 can be slid in a predetermined range defined by the attachment groove 27'. A plurality of marking 35, which are used to check the position of the slide member 70, are formed in an upper part of the side wall 27. Here, the markings 35 define the three positions A to C.

Referring to FIGS. 12 to 15, a method of assembling the electrical connector 1 will be described.

Figure 12:
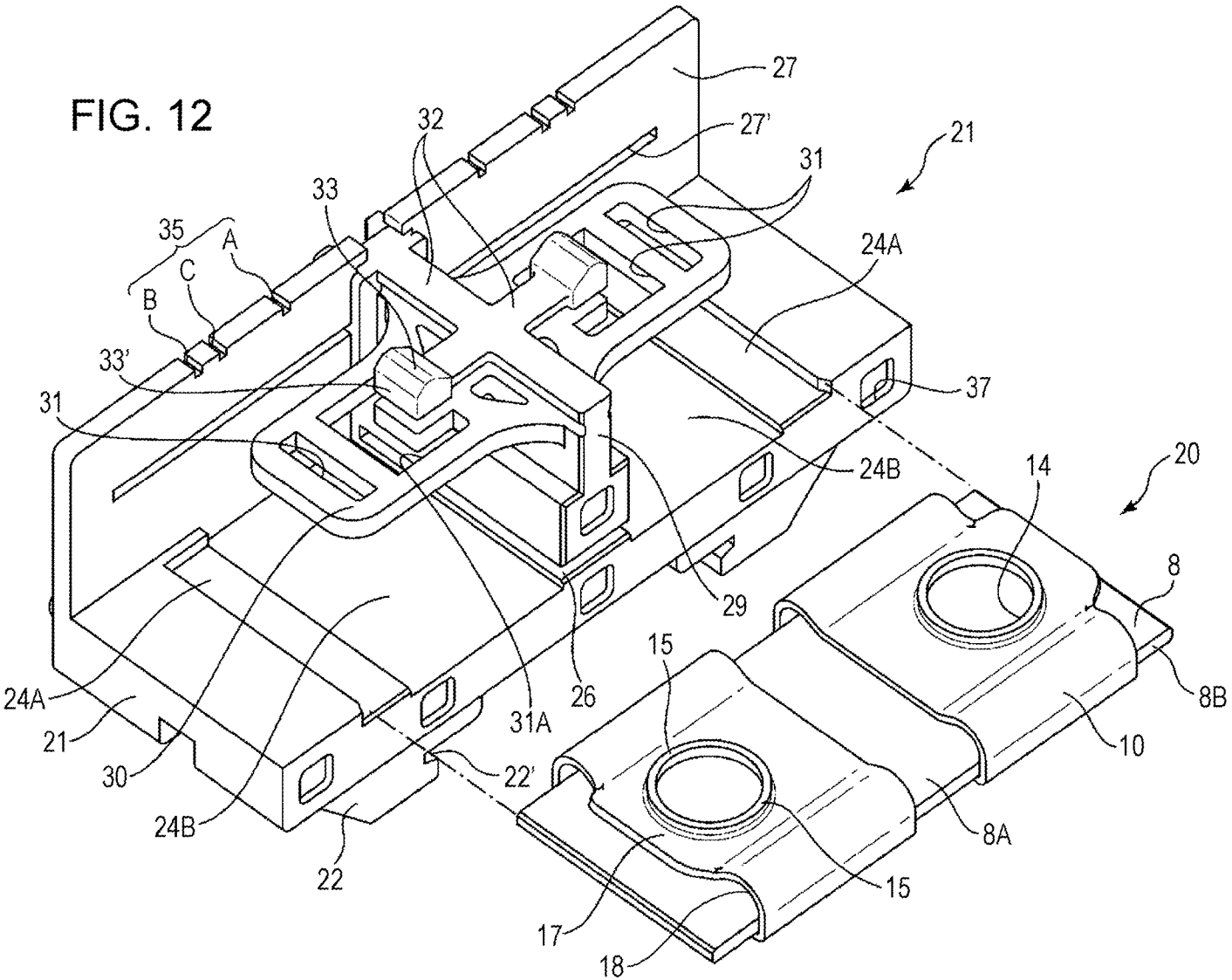
FIG. 12 illustrates a method of assembling the electrical connector.

When assembling the electrical connector 1, first, the clamping device 20 is attached to the housing 21 as shown in FIG. 12. The clamping device 20 is laterally inserted through the gap 26 between the upright portion 29 of the housing 21 and the base body 23 and is placed at a predetermined position in the housing 21 by using the stepped portions 24 of the base body 23.

Figure 13A:
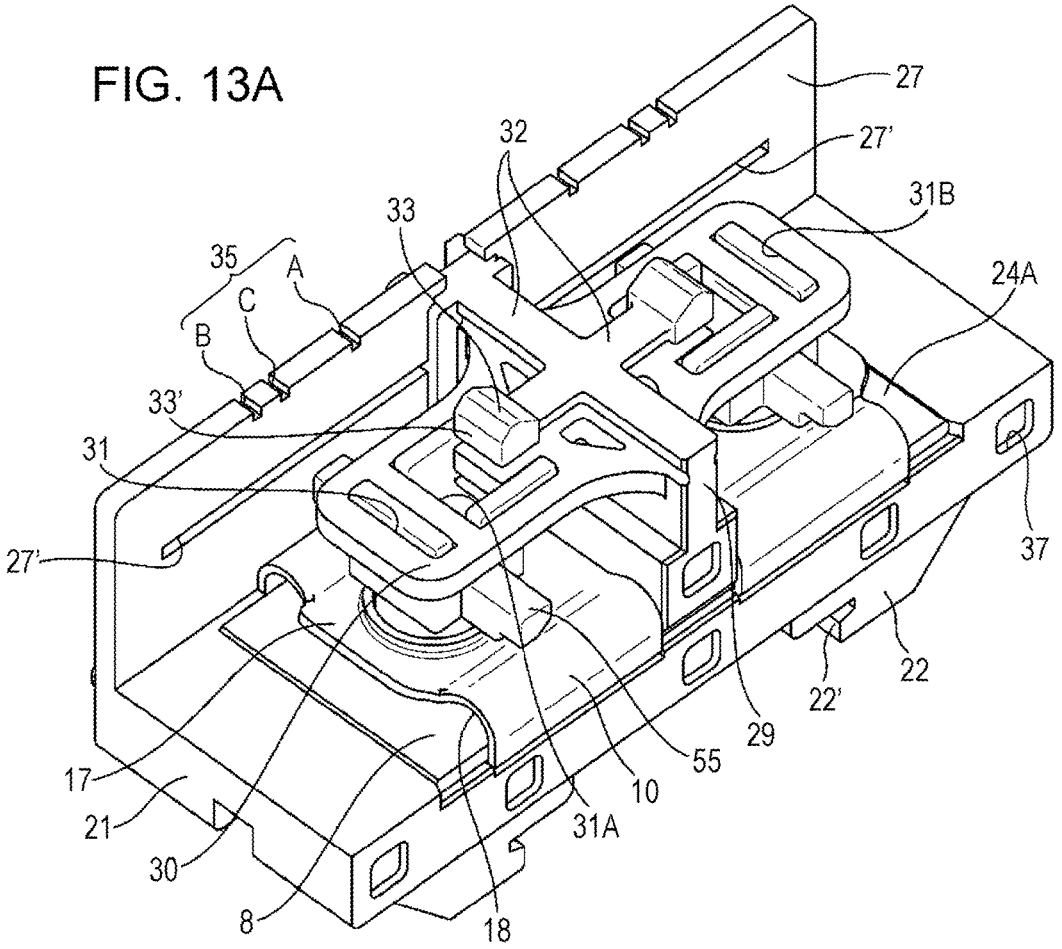
FIGS. 13A and 13B illustrate the method of assembling the electrical connector.
Figure 13B:
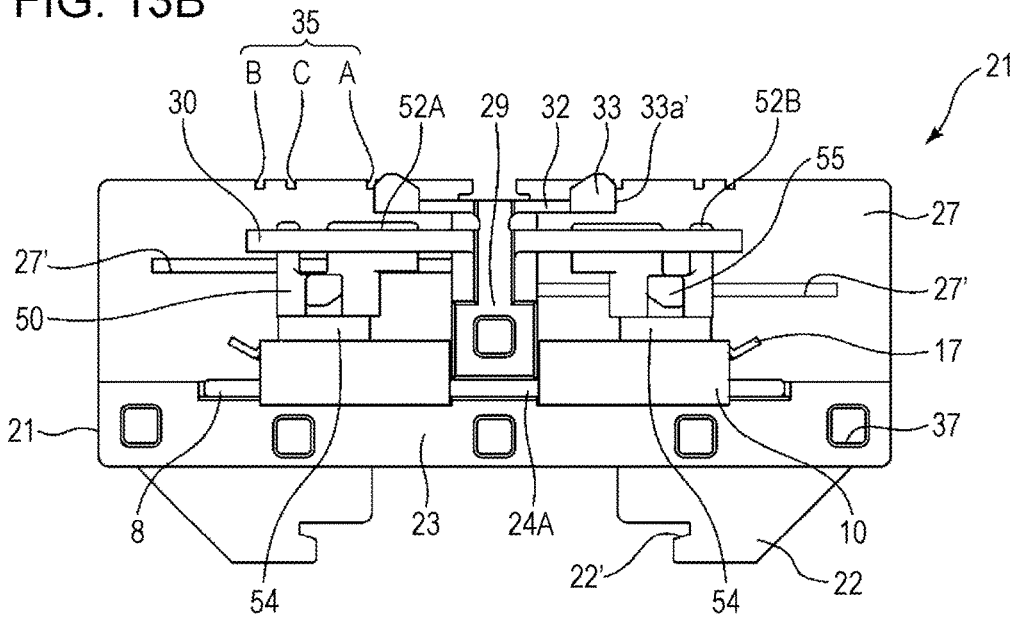

Next, the movable member 50 is attached to the housing 21. For example, the holding piece 30 is pulled and displaced upward, and, in this state, the movable member 50 is attached to the housing 21 by sliding the movable member 50 into a space between the holding piece 30 and the base body 23. FIGS. 13A and 13B illustrate the housing 21 to which the movable member 50 has been attached. FIG. 13A is a perspective view similar to FIG. 12, and FIG. 13B is a side view.

Figure 14:
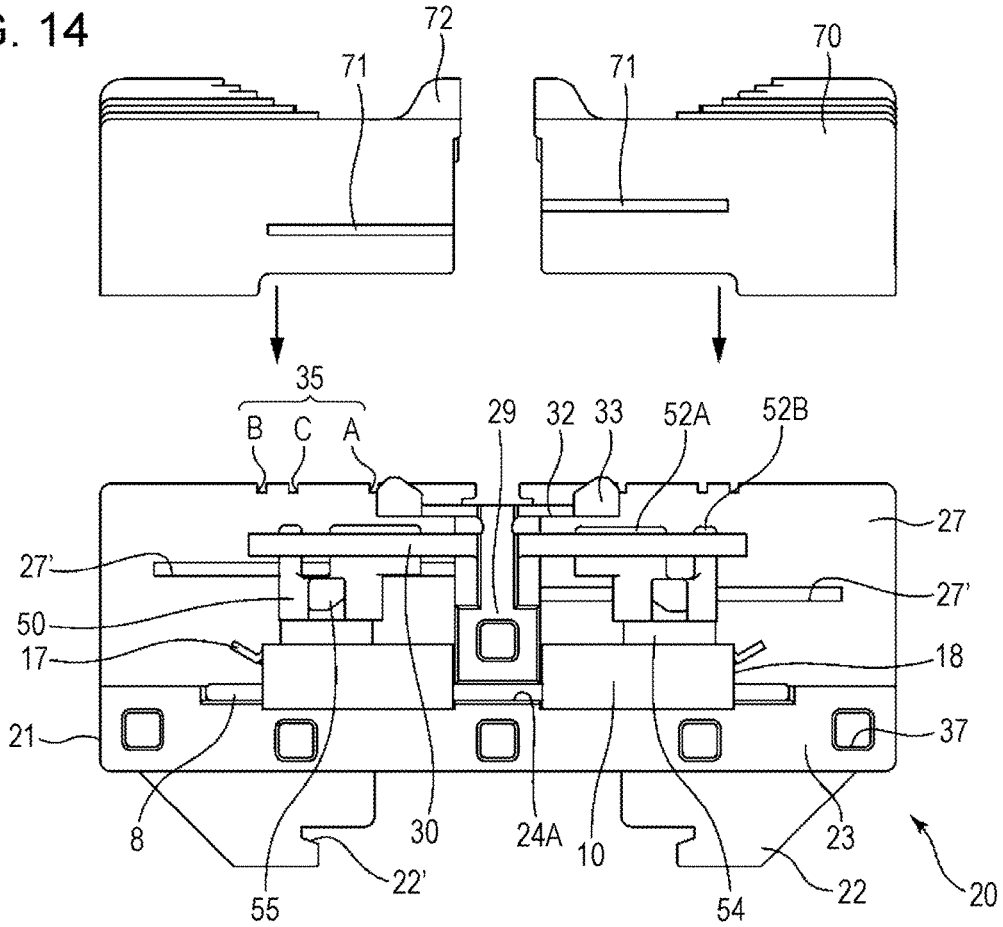
FIG. 14 illustrates the method of assembling the electrical connector.
Figure 15:
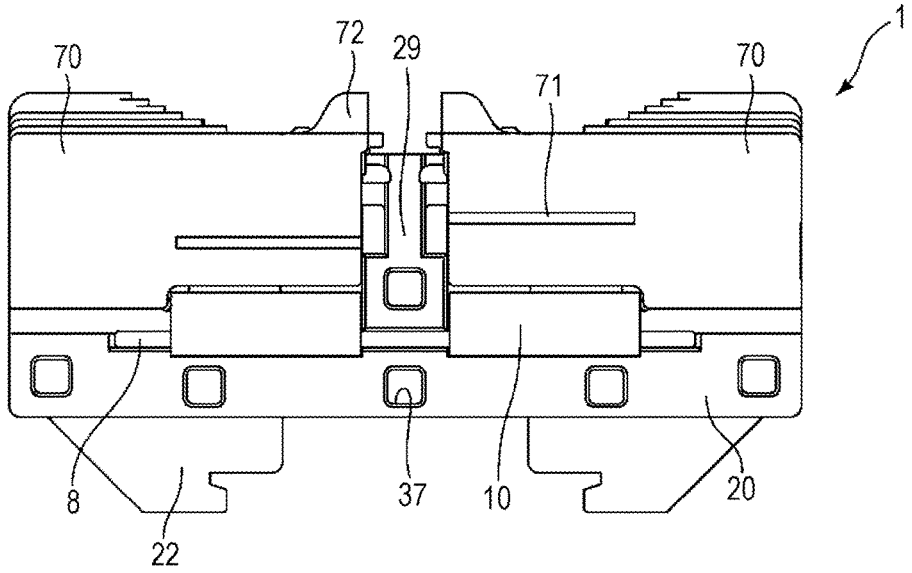
FIG. 15 illustrates the method of assembling the electrical connector.

As illustrated in FIGS. 14 and 15, the slide members 70 are attached to the housing 21. When attaching to the housing 21, one side of the electrical connector 1 has not been closed. Therefore, the slide members 70 can be easily attached to the housing 21. Each of the slide members 70 is attached to the housing 21 so that the outer wall protrusion 71 thereof is inserted into the attachment groove 27' of the side wall 27. After the state shown in FIG. 15, the open side is closed by using the side wall 27*a* (shown in FIG. 1) to complete the assembly of the electrical connector 1.

In the method described above, the movable member 50 is attached to the housing 21 after attaching the clamping device 20 to the housing 21. However, this is not a limitation. For example, the clamping device 20 may be attached to the housing 21 after attaching the movable member 50 to the housing 21.

Lastly, a method of inserting and fixing the terminal 4 into and to the electrical connector 1 and a method of extracting the terminal 4 from the electrical connector 1 will be described.

Figure 16A:
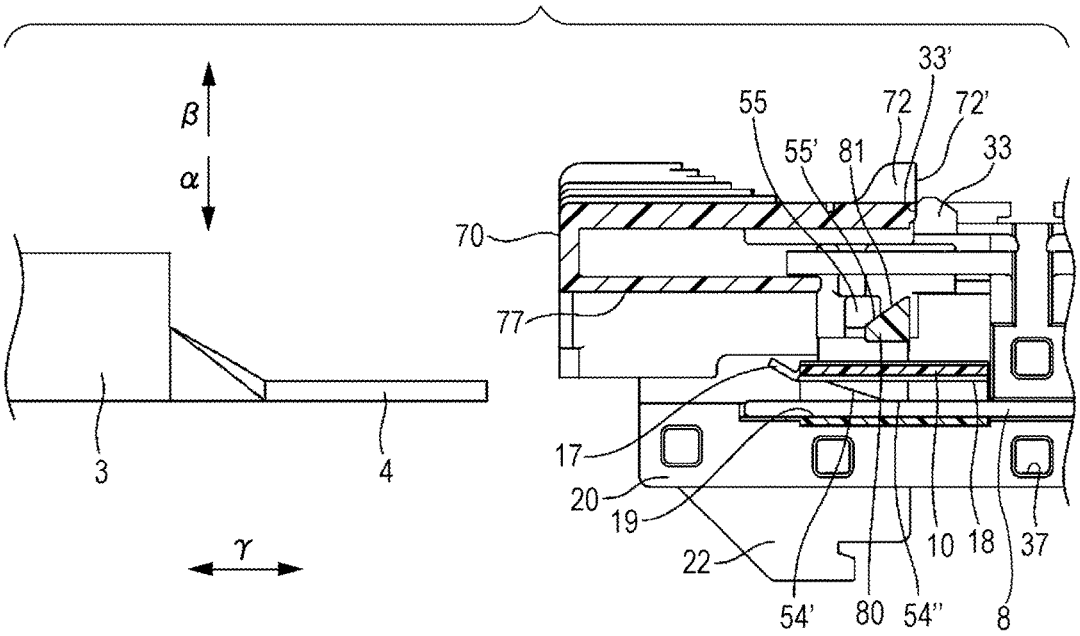
FIGS. 16A and 16B illustrate a method of inserting and fixing the terminal.
Figure 16B:
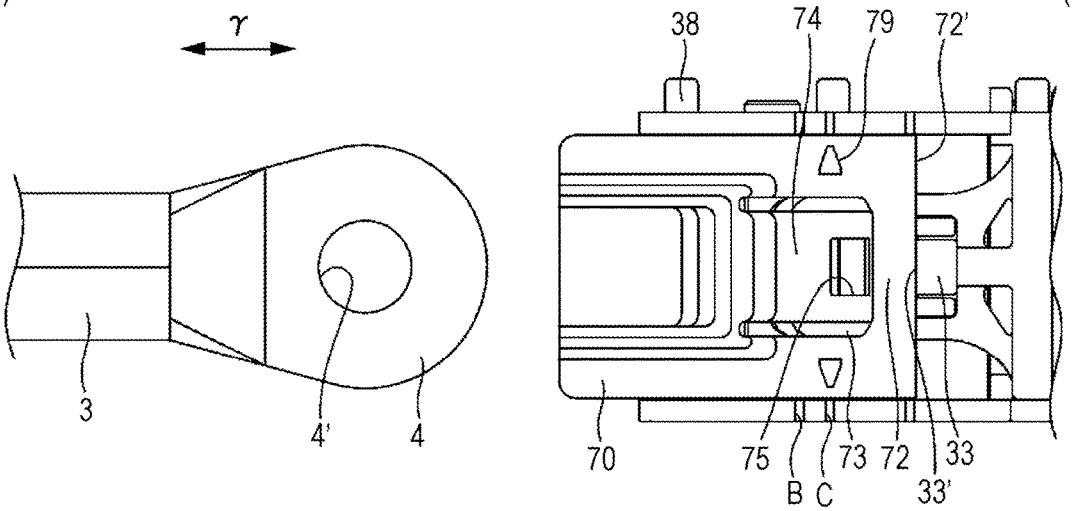
Figure 17A:
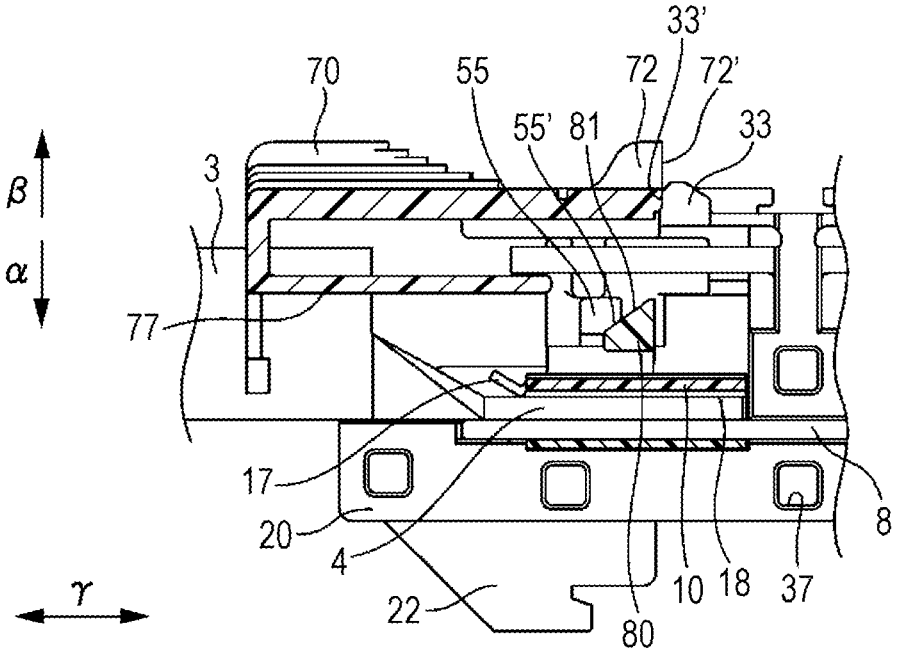
FIGS. 17A and 17B illustrate the method of inserting and fixing the terminal.
Figure 17B:
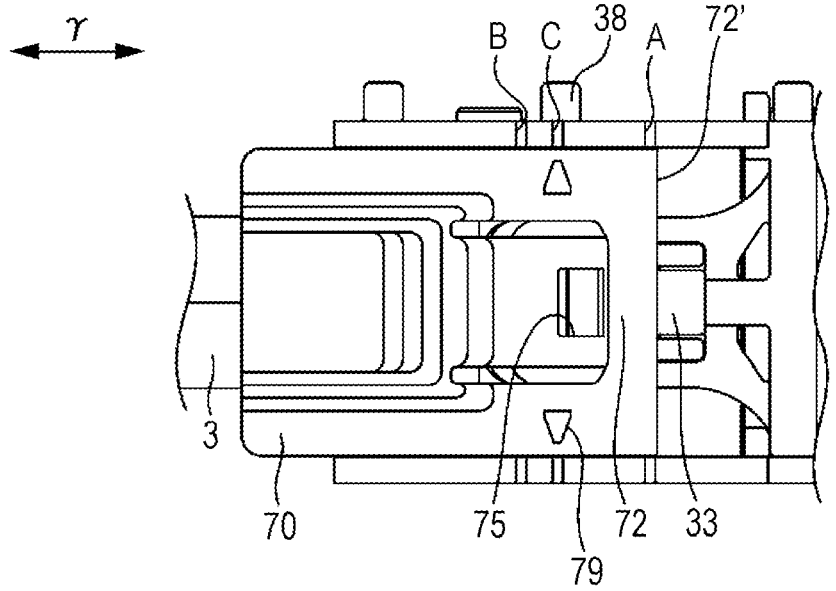
Figure 18A:
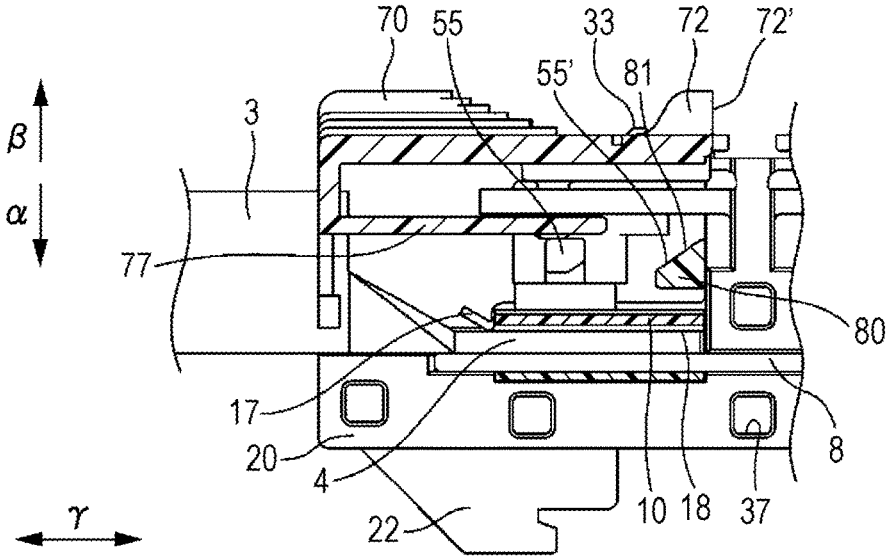
FIGS. 18A and 18B illustrate the method of inserting and fixing the terminal.
Figure 18B:
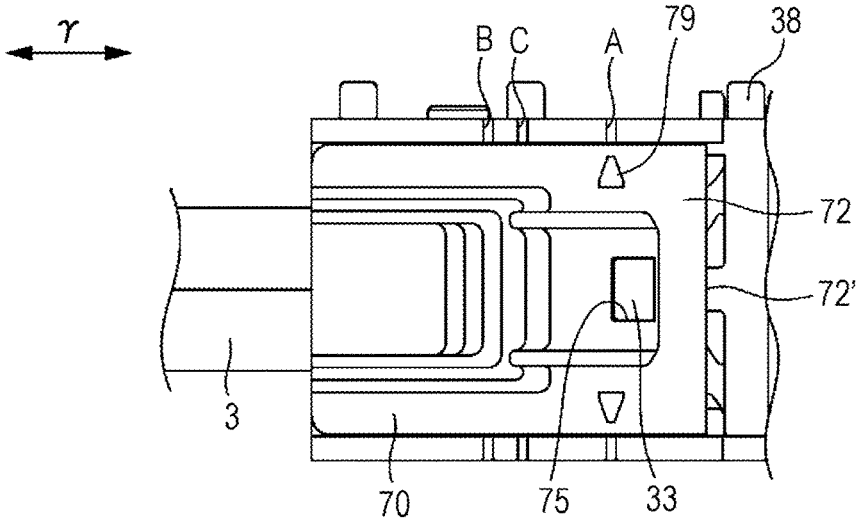

First, referring to FIGS. 16A to 18B, a method of inserting and fixing the terminal 4 will be described. FIGS. 16A, 17A, and 18A are side sectional views of the electrical connector 1. FIGS. 16B, 17B, and 18B are plan views of the electrical connector 1.

As illustrated in FIGS. 16A and 16B, when inserting the terminal 4, the slide member 70 is moved in the "γ" direction to the position C. When the slide member 70 is at the position C, the inner wall protrusion 77 of the slide member 70 is not located on a separation side of the arm portions 55 of the movable member 50, that is, not located in a separation direction (β) from the arm portions 55 in which the movable member 50 becomes separated from the terminal 4. The inclined portion 80 of the slide member 70 is located in an approaching direction (α) from the arm portions 55 of the movable member 50, is in a state in which the inclined portion 80 is capable of coming into contact with the movable member 50, and has not substantially moved the movable member 50. In other words, when the slide member 70 is at the position C, the movable member 50 receives substantially no force from the inclined portion 80 of the slide member 70 in the approach direction (α) or in the separation direction (β) from the movable member 50. Hence, when the slide member 70 is at the position C, the movable member 50 can freely move in the direction in which the terminal 4 pushes up the movable member 50, that is, in the separation direction (β). Moreover, when the slide member 70 is at the position C, the surface 72' of the front end portion 72 of the slide member 70 abuts against the collision surface 33' of the lock projection 33. Thus, the position C can be stably maintained. Preferably, the movement directions (α, β) of the movable member 50 are perpendicular to the slide direction "γ" of the slide member 70.

When the terminal 4 is inserted into the housing 21 in the state illustrated in FIGS. 16A and 16B, that is, when the terminal 4 is laterally inserted into the gap 18 of the accommodation portion 19 into which the electroconductive member 8 has been inserted, an end portion of the terminal 4 collides with the inclined portion 54' of the stopper 54 of the movable member 50. As a result, the movable member 50 is pushed up in the separation direction (β) in the thickness direction of the terminal 4. Subsequently, the movable member 50, which has been pushed up in the separation direction (β), reaches the through-hole 4' of the terminal 4. Then, the stopper 54 of the movable member 50 moves downward in the approach direction (α) and is fitted into the through-hole 4' of the terminal 4. As a result, the terminal 4 is fixed in place by the stopper 54. FIGS. 17A and 17B illustrate this state. Because the horizontal portion 54" is formed at the end of the stopper 54, the stopper 54 is stably positioned at the place.

When the stopper 54 of the movable member 50 has been fitted into the through-hole 4' of the terminal 4 to be in the state illustrated in FIGS. 17A and 17B, the slide member 70 can be moved to the position A illustrated in FIGS. 18A and 18B. When the slide member 70 is at the position A, the inner wall protrusions 77 of the slide member 70 are in contact with or is capable of coming into contact with the arm portions 55 in the separation direction (β) from the terminal 4. Therefore, movement of the movable member 50 in the separation direction (β) from the terminal 4, which has been inserted into the electrical connector 1, is prevented. As a result, engagement of the terminal 4 with the movable member 50 can be reliably maintained, and accidental extraction of the terminal 4 from the electrical connector 1 can be prevented. The position A can be fixed by using a structure in which the lock projection 33 of the housing (see FIG. 2 and other figures) can be fitted into the lock hole 75 of the elastic displacement portion 74 of the slide member 70. By fixing the position A, the slide member 70 cannot be accidentally slid toward the position B. Accordingly, accidental extraction of the terminal 4 from the electrical connector 1 can be prevented. In this case, the terminal 4 cannot be extracted from the housing 21 unless at least the locked state of the lock hole 75 and the lock projection 33 is released.

If the stopper 54 of the movable member 50 were in a so-called half-fitted state in which the stopper 54 is not appropriately fitted into the through-hole 4' of the terminal 4, the stopper 54 would continue to be pushed up in the separation direction (β) by the thickness portion of the terminal 4. In this case, even if a user tried to slide the slide member 70 to the position A, the slide member 70 would not be moved to the position A, because the arm portions 55 of the movable member 50 and the inner wall protrusion 77 of the slide member 70 would collide each other in the slide direction. Thus, by using this mechanism, a user can easily check whether the stopper 54 of the movable member 50 has been appropriately fitted into the through-hole 4' of the terminal 4 by checking whether the slide member 70 is located at the position A.

Next, referring to FIGS. 19A to 20B in addition to FIGS. 17A to 18B, a method of extracting the terminal 4 will be described. FIGS. 19A to 20B illustrate the terminal 4, the movable member 50, and the like in the same way as FIGS. 16A to 18B.

Figure 19A:
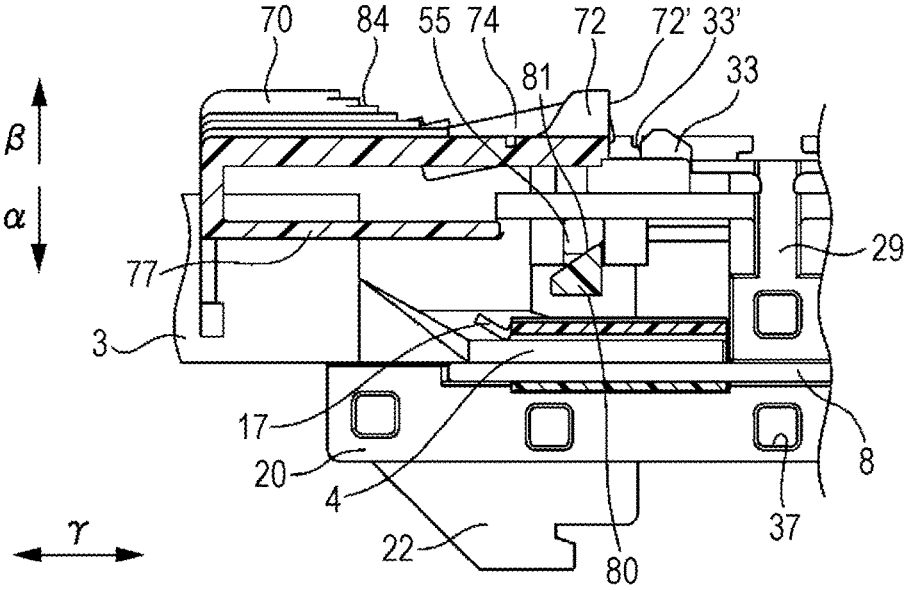
FIGS. 19A and 19B illustrate a method of extracting the terminal.
Figure 19B:
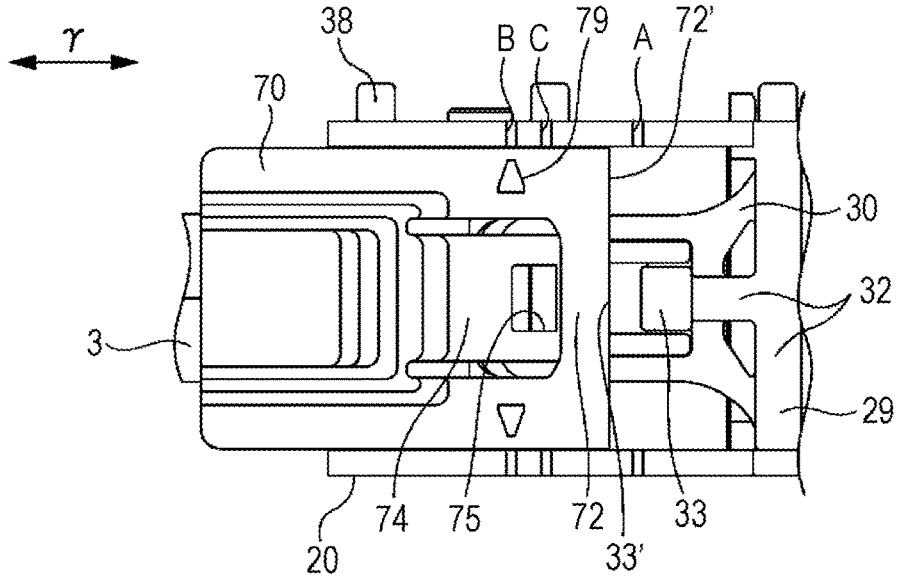
Figure 20A:
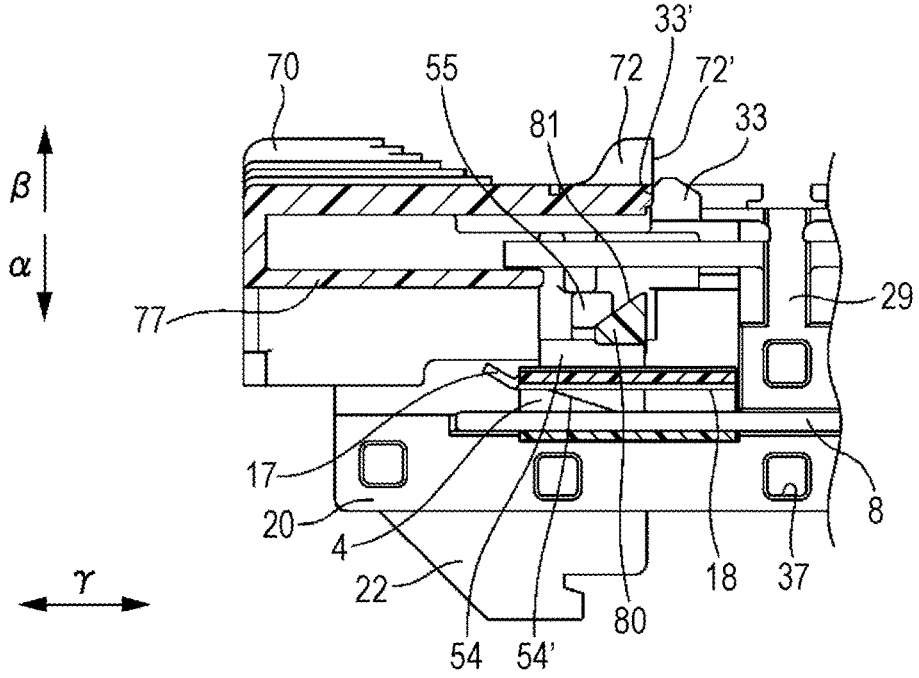
FIGS. 20A and 20B illustrate the method of extracting the terminal.
Figure 20B:
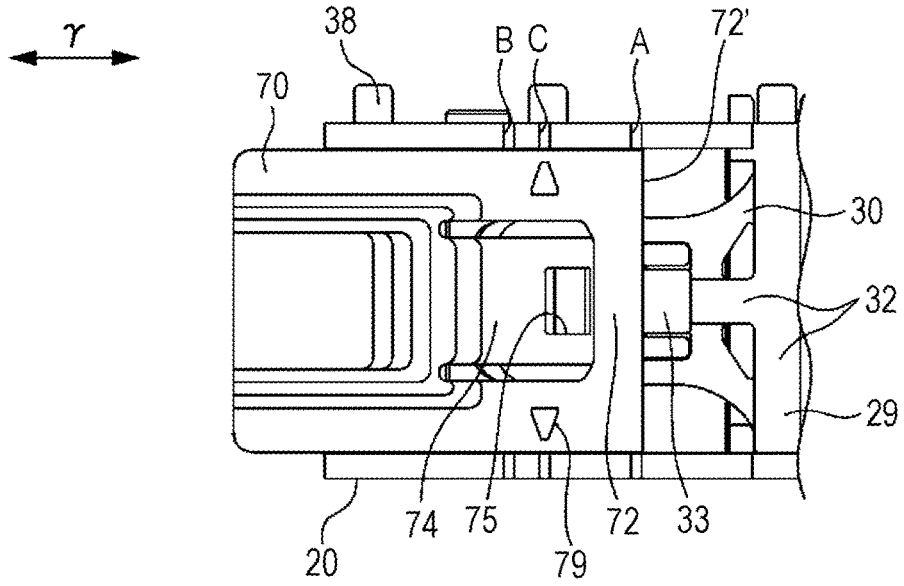
Figure 21:
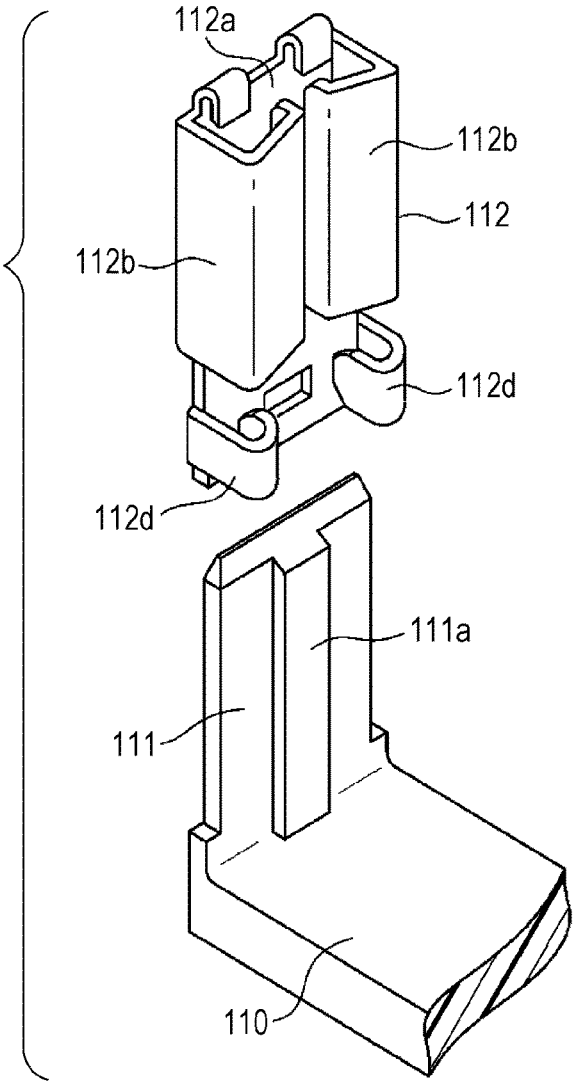
FIG. 21 Prior Art
FIG. 21 is a perspective view of a terminal holding member and an electroconductive member of an existing device.
Figure 22:
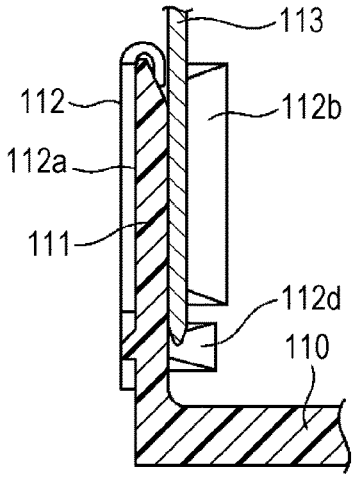
FIG. 22 Prior Art
FIG. 22 is a sectional view of a clamping device including the terminal holding member and the electroconductive member of the existing device.

When extracting the terminal 4, the slide member 70 is moved from the position A shown in FIGS. 18A and 18B to the position C shown in FIGS. 17A and 17B, and is further moved to the position B shown in FIGS. 19A and 19B. However, in order to enable extraction of the terminal 4, it is not necessary to move the slide member 70 from the position C to the position B, because the terminal 4 can be extracted by only moving the slide member 70 from the position A to the position C. However, as will be made clear in the following description, moving the slide member 70 from the position C to the position B brings the following advantages: the terminal 4 can be extracted more easily; and the operation is simplified because the slide member 70 can automatically return from the position B to the position C. Note that the slide member 70 cannot be excessively moved from the position C beyond the position B. This is because, as described above with reference to FIG. 7 and other figures, the outer wall protrusions 71 of the slide member 70 are fitted into the attachment grooves 27' of the housing 21, each having a predetermined length.

As is clear from FIGS. 19A and 19B, when the slide member 70 is at the position B, the inner wall protrusion 77 of the slide member 70 is not located in the separation direction (β) from the arm portions 55 of the movable member 50. The inclined portion 80 of the slide member 70 is in contact with the inclined portion 55' of the arm portion 55 of the movable member 50 in the approach direction (α) from the arm portion 55 and is pushing up the arm portion 55 in the separation direction (β). Accordingly, when the slide member 70 is at the position B, the movable member 50 (the stopper 54) has been extracted from the through-hole 4' of the terminal 4, so that the terminal 4 can be easily extracted from the housing 21 without colliding with the movable member 50. Preferably, the inclined portion 80 has the inclined surface 81 so that the slide member 70 and the movable member 50 can be easily moved in the slide direction of the slide member 70. In this case, the inclined portion 80 of the slide member 70 can be easily moved to a position below the inclined portion 55' of the arm portion 55, that is, can be moved in the approach direction (α), and the slide member 70 can be easily moved or the movable member 50 can be easily moved in the separation direction (β).

Note that, when the slide member 70 is at the position B, the movable member 50 is urged in the separation direction (β) through contact with the inclined portion 80, and the elastic displacement portion 74 is displaced in the separation direction (β) by the push-up portion 52 of the movable member 50, which is being urged. Clearly, when a user releases the slide member 70 in this state, the movable member 50 is urged in the approach direction (α) by a repulsive force received from the elastic displacement portion 74. As a result, the slide member 70 automatically returns from the unstable position B to the stable position C shown in FIGS. 20A and 20B through contact between the inclined surface 81 of the slide member 70 and the inclined portion 55' of the movable member 50. Thus, with the present structure, it is not necessary for a user to return the slide member 70 from the position B to the position C.

The present invention is not limited to the embodiment described above. The embodiment can be modified in various ways. For example, in the embodiment, the arm portions 55 of the movable member 50 come into contact with the inner wall protrusions 77 or the inclined portions 80 of the slide member 70. However, this is not a limitation. For example, parts of the movable member 50 other than the arm portions 55 may come into contact with the inner wall protrusions 77 or the inclined portions 80 of the slide member 70. Alternatively, parts of the slide member 70 other than the inner wall protrusions 77 and the inclined portions 80 may come into contact with the arm portions 55. The number of the positions of the cover is not limited to three. For example, the position C, which is between the position A and the position B, may be omitted. Alternatively, an additional position may be provided. The elastic displacement portion 74 may be omitted.

The present invention can be widely applied to terminal holding members for holding a mating terminal and an electroconductive member together.

What is claimed is:

1. A terminal holding member having a tubular shape and including an accommodation portion into which an electroconductive member is inserted, the terminal holding member elastically holding a mating terminal and the electroconductive member when the mating terminal is inserted into a gap that is formed by the accommodation portion and the electroconductive member inserted into the accommodation portion, the terminal holding member comprising:

a bottom portion that supports a bottom surface of the electroconductive member inserted into the accommodation portion;

a surface-contact portion comprising an inner surface that faces the bottom portion and that is capable of coming into surface-contact with a first surface of the mating terminal; and a spring portion that connects the bottom portion and the surface-contact portion to each other so that the terminal holding member has spring properties with which the surface-contact portion is urged toward the bottom portion, the spring portion comprising an arch-shaped portion, wherein a distance in a direction perpendicular to the inner surface of the surface-contact portion between a top of the arch-shaped portion and the bottom portion is longer than a distance in the direction perpendicular to the inner surface of the surface-contact portion between the surface-contact portion and the bottom portion.

2. The terminal holding member according to claim 1, wherein a top surface of the electroconductive member and a second surface of the mating terminal come into surface-contact with each other along a flat surface.

3. The terminal holding member according to claim 1, wherein the surface-contact portion has a through-hole through which a movable member is to be inserted, the movable member being engageable with the mating terminal inserted into the gap to prevent extraction of the mating terminal from the terminal holding member.

4. The terminal holding member according to claim 3, further comprising:

an upright portion that is disposed around the through-hole so as to protrude along a movement direction of the movable member on a side from which the movable member is inserted into the through-hole.

5. The terminal holding member according to claim 1, further comprising:

a guide portion for the mating terminal, the guide portion being disposed at an edge of the surface-contact portion and being inclined toward the accommodation portion.

6. The terminal holding member according to claim 1, wherein the terminal holding member is made by shaping a single metal plate so that a gap between abutting edges of the metal plate is located in the bottom portion.

7. The terminal holding member according to claim 1, wherein the electroconductive member is a flat plate member.

8. The terminal holding member according to claim 1, wherein the terminal holding member is made of a stainless steel or a stainless steel alloy.

9. A clamping device comprising:

the terminal holding member according to claim 1; and the electroconductive member.

10. The terminal holding member according to claim 6, wherein the terminal holding member has the single gap between the abutting edges of the metal plate in the bottom portion.

11. The terminal holding member according to claim 6, wherein the terminal holding member has two bottom portions, one edge of the single metal plate is one of the two bottom portions, and another edge of the single metal plate, which is opposite to the one edge of the single metal plate, is the other of the two bottom portions.

12. A terminal holding member having a tubular shape and including an accommodation portion into which an electroconductive member is inserted, the terminal holding member elastically holding a mating terminal and the electroconductive member when the mating terminal is inserted into a gap that is formed by the accommodation portion and the electroconductive member inserted into the accommodation portion, the terminal holding member comprising:

a bottom portion that supports a bottom surface of the electroconductive member inserted into the accommodation portion;

a surface-contact portion that faces the bottom portion and that is capable of coming into surface-contact with a first surface of the mating terminal; and two spring portions, each of the two spring portion connecting the bottom portion and the surface-contact portion to each other so that the terminal holding member has spring properties with which the surface-contact portion is urged toward the bottom portion, each of the two the spring portions being in direct contact with the bottom portion and the surface-contact portion, wherein inner surfaces of the two spring portions are in parallel to a direction in which the electroconductive member is inserted into the accommodation portion.

* * * * *